US011724518B2

(12) United States Patent
Kuramoto

(10) Patent No.: US 11,724,518 B2
(45) Date of Patent: Aug. 15, 2023

(54) PRINTER AND CONTROL METHOD FOR PRINTER

(71) Applicant: SEIKO EPSON CORPORATION, Tokyo (JP)

(72) Inventor: Hiroyuki Kuramoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/316,386

(22) Filed: May 10, 2021

(65) Prior Publication Data

US 2021/0347184 A1 Nov. 11, 2021

(30) Foreign Application Priority Data

May 11, 2020 (JP) ..... 2020-083072

(51) Int. Cl.

| | |
|---|---|
| ***B41J 3/36*** | (2006.01) |
| ***B41J 3/39*** | (2006.01) |
| ***B41J 3/28*** | (2006.01) |
| ***B41J 2/155*** | (2006.01) |

(52) U.S. Cl.

CPC ..... *B41J 3/39* (2013.01); *B41J 2/155* (2013.01); *B41J 3/28* (2013.01); *B41J 3/36* (2013.01)

(58) Field of Classification Search

CPC ..... B41J 3/36; B41J 3/39; B41J 3/28; B41J 2/155

See application file for complete search history.

(56) References Cited

U.S. PATENT DOCUMENTS

| | | | | |
|---|---|---|---|---|
| 11,288,022 | B2 * | 3/2022 | Kuramoto | G06F 3/1284 |
| 2007/0120937 | A1 * | 5/2007 | Ahne | B41J 3/36 347/109 |
| 2007/0223982 | A1 * | 9/2007 | Miller | B41J 3/46 400/88 |
| 2018/0250947 | A1 | 9/2018 | Nakata et al. | |
| 2018/0354257 | A1 * | 12/2018 | Watanabe | B41J 3/36 |
| 2019/0091997 | A1 * | 3/2019 | Shinohara | B41J 2/04505 |

FOREIGN PATENT DOCUMENTS

| | | |
|---|---|---|
| JP | 2018-144338 | 9/2018 |

* cited by examiner

*Primary Examiner* — Christopher E Mahoney
*Assistant Examiner* — Kendrick X Liu
(74) *Attorney, Agent, or Firm* — Workman Nydegger

(57) ABSTRACT

A printer that performs printing on a medium while being manually moved relative to the medium, includes a job acquisition unit that acquires a print job in which a movement direction of the printer as seen from the printer is designated, a print head that performs printing on the medium based on the print job while the printer is moved, and a direction notification unit that notifies a user of a designated direction as the movement direction of the printer designated by the print job before the movement of the printer is started.

10 Claims, 27 Drawing Sheets

PRINTER AND CONTROL METHOD FOR PRINTER

The present application is based on, and claims priority from JP Application Serial Number 2020-083072, filed May 11, 2020, the disclosure of which is hereby incorporated by reference herein in its entirety.

BACKGROUND

1. Technical Field

The present disclosure relates to a printer and a control method for a printer.

2. Related Art

In related art, as disclosed in JP-A-2018-144338, a printer that performs printing on a medium while being manually moved relative to the medium is known. The printer can perform printing while being moved in a rightward direction as seen from the printer and while being moved in a leftward direction as seen from the printer.

The printer in related art may improperly print a print image when being moved in a direction different from a movement direction designated by a print job.

SUMMARY

A printer according to an aspect of the present disclosure is a printer that performs printing on a medium while being manually moved relative to the medium, including a job acquisition unit that acquires a print job in which a movement direction of the printer as seen from the printer is designated, a print head that performs printing on the medium based on the print job while the printer is moved, and a direction notification unit that notifies a user of a designated direction as the movement direction of the printer designated by the print job before the movement of the printer is started.

A control method for a printer according to an aspect of the present disclosure is a control method for a printer that performs printing on a medium while being manually moved relative to the medium, including acquiring a print job in which a movement direction of the printer as seen from the printer is designated, performing printing on the medium based on the print job while the printer is moved, and notifying a user of a designated direction as the movement direction of the printer designated by the print job before the movement of the printer is started.

DESCRIPTION OF EXEMPLARY EMBODIMENTS

As below, embodiments of a printer and a control method for a printer will be explained with reference to the accompanying drawings.

First Embodiment

Figure 1:
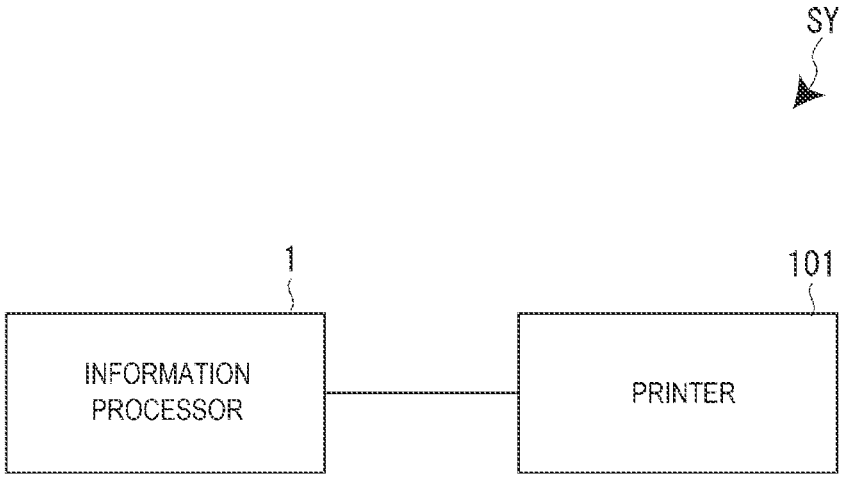
FIG. 1 is a system configuration diagram of a printing system.

FIG. 1 is a system configuration diagram of a printing system SY. The printing system SY includes an information processor 1 and a printer 101. The information processor 1 and the printer 101 are communicably coupled via wired or wireless connection.

The information processor 1 transmits a print job to the printer 101. As the information processor 1, e.g. a smartphone, a tablet terminal, or a personal computer may be used.

The printer 101 performs printing on a medium 201 (see FIG. 5) according to the print job received from the information processor 1. The printer 101 is the so-called handy printer and performs printing while being manually moved relative to the medium 201. Note that the medium 201 is not limited to printing paper, but e.g. an envelope, a postcard, a business card, a cardboard, a notebook, a CD (Compact Disc), etc. may be used.

Figure 2:
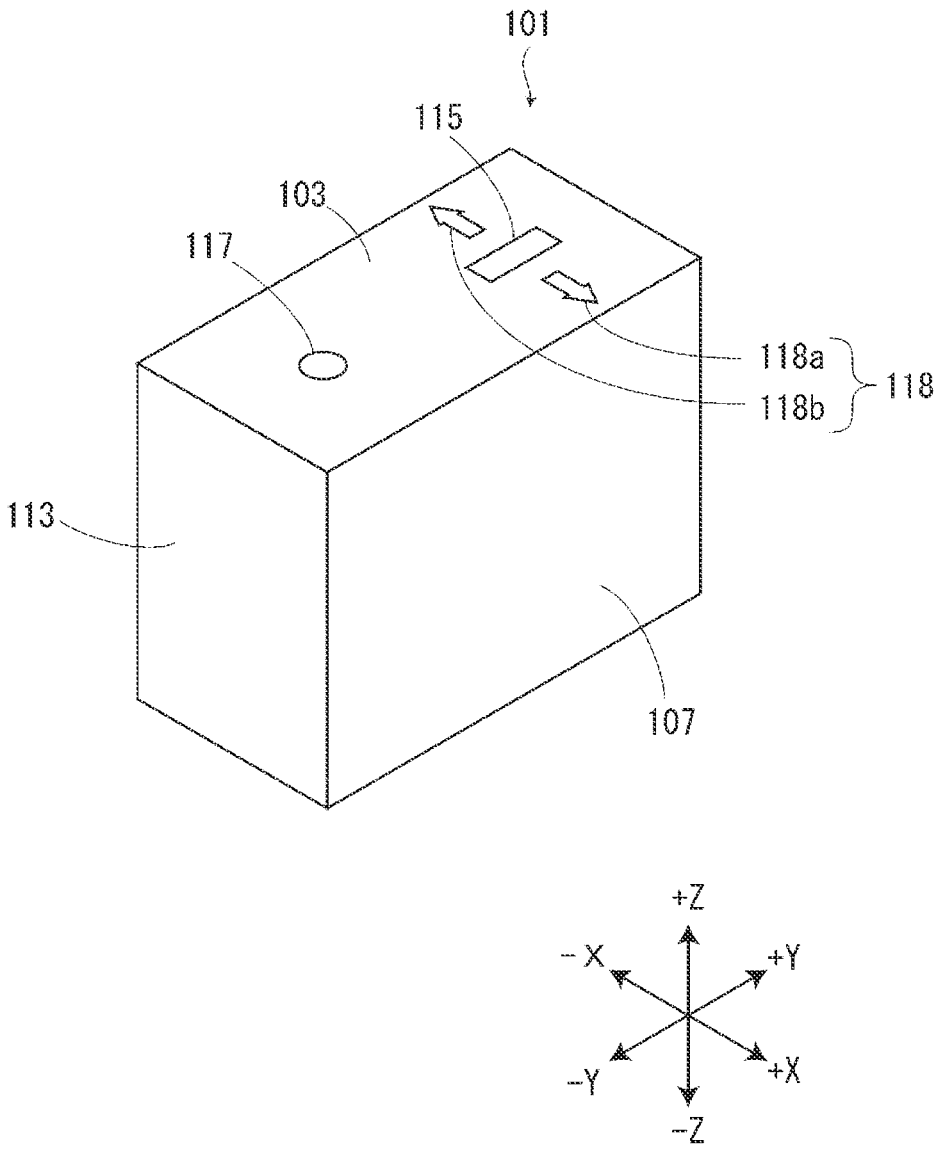
FIG. 2 is an appearance perspective view of a printer.
Figure 3:
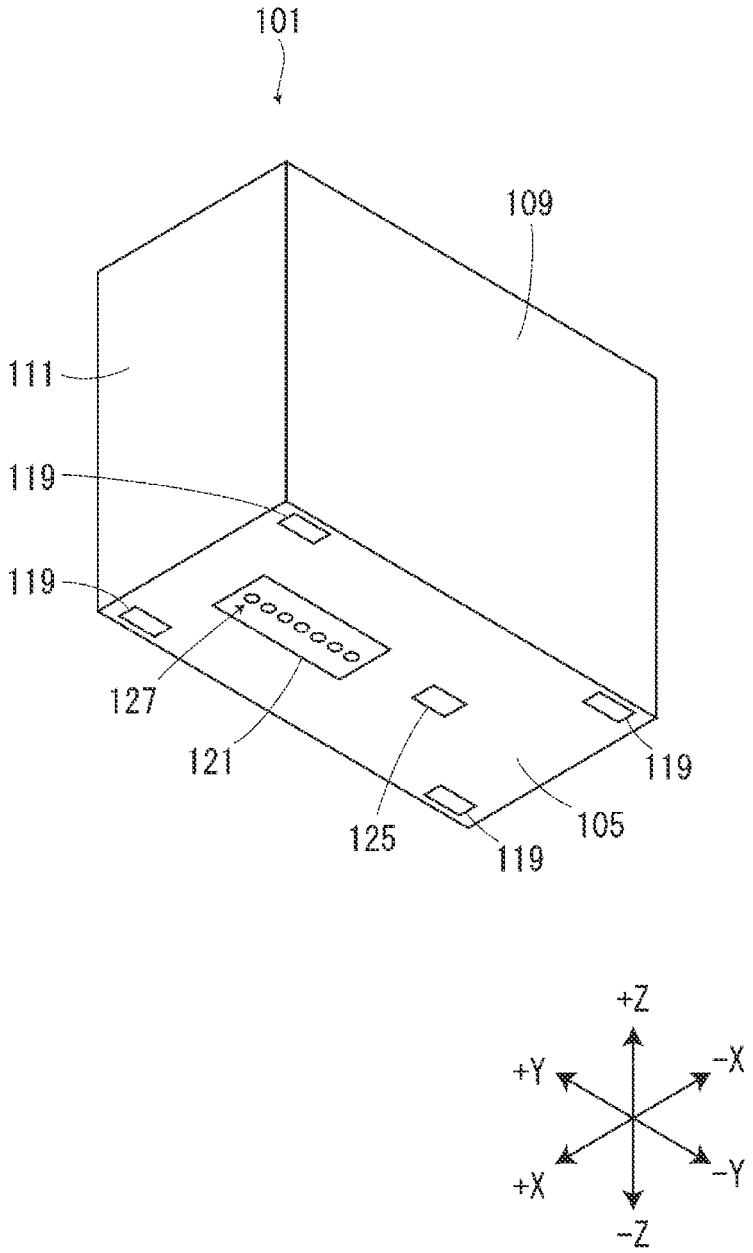
FIG. 3 is an appearance perspective view of the printer as seen from a different angle from that in FIG. 2.

An appearance configuration of the printer 101 will be explained with reference to FIGS. 2 and 3. Note that, as below, directions as seen from the printer 101 will be explained using directions of the XYZ orthogonal coordinate system shown in the respective drawings, however, these directions are only for convenience of explanation and do not limit the following embodiments.

The printer 101 is formed substantially in a rectangular parallelepiped shape. Of the six outer surfaces of the printer 101, an outer surface with a print button 115, which will be described later, provided thereon is referred to as "first outer surface 103" and an outer surface opposite to the first outer surface 103 is referred to as "second outer surface 105". Of the four outer surfaces corresponding to side surfaces when the first outer surface 103 or the second outer surface 105 is regarded as a bottom surface, one of the two outer surfaces having larger areas is referred to as "third outer surface 107" and the other is referred to as "fourth outer surface 109". Of the four outer surfaces corresponding to the side surfaces, one of the two outer surfaces having smaller areas is referred to as "fifth outer surface 111" and the other is referred to as "sixth outer surface 113". That is, the first outer surface 103, the second outer surface 105, the third outer surface 107, the fourth outer surface 109, the fifth outer surface 111, and the sixth outer surface 113 are provided at sides in a +Z direction, a −Z direction, a +X direction, a −X direction, a +Y direction, and a −Y direction, respectively, as seen from the printer 101.

On the first outer surface 103 of the printer 101, the print button 115, a power button 117, and a direction indicator 118 are provided.

Figure 5:
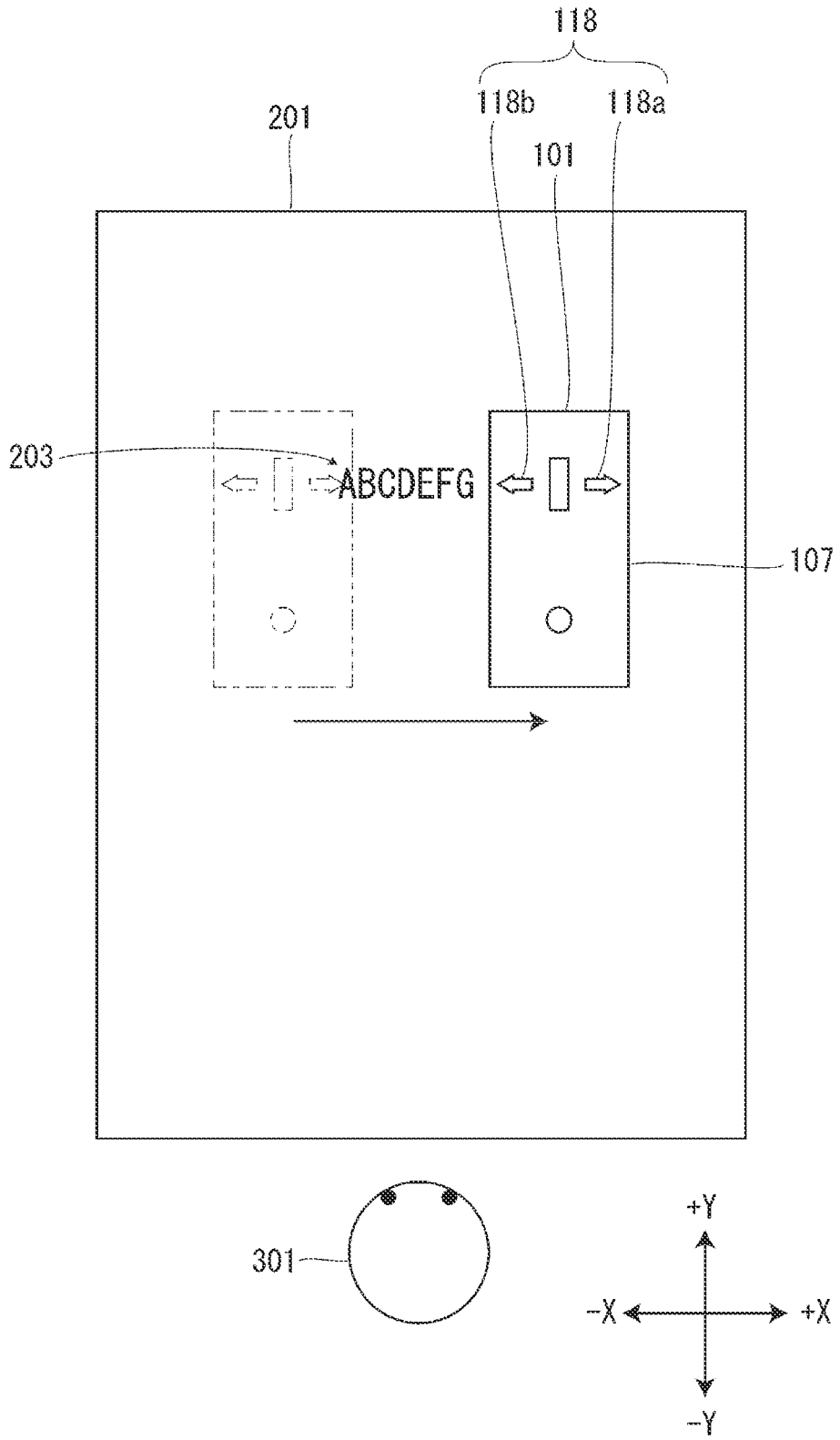
FIG. 5 shows a state in which the printer is moved in a +X direction when a user moves the printer to the right as seen from the user.

The print button 115 receives a print instruction from a user 301 (see FIG. 5). The print button 115 is provided at a side in the +Y direction relative to a center portion of the first outer surface 103. Further, the print button 115 is provided at a side in the +Z direction relative to a print head 121. That is, the print button 115 is provided in a position corresponding to the print head 121 on the first outer surface 103. The user 301 places the printer 101 on the medium 201, then, presses the print button 115 and moves the held printer 101 freehand along the surface of the medium 201, and thereby, controls the printer 101 to print a print image 203 (see FIG. 5).

The power button 117 receives a switch instruction of ON/OFF of power from the user 301. The power button 117 is provided at a side in the −Y direction relative to the center portion of the first outer surface 103.

Figure 4:
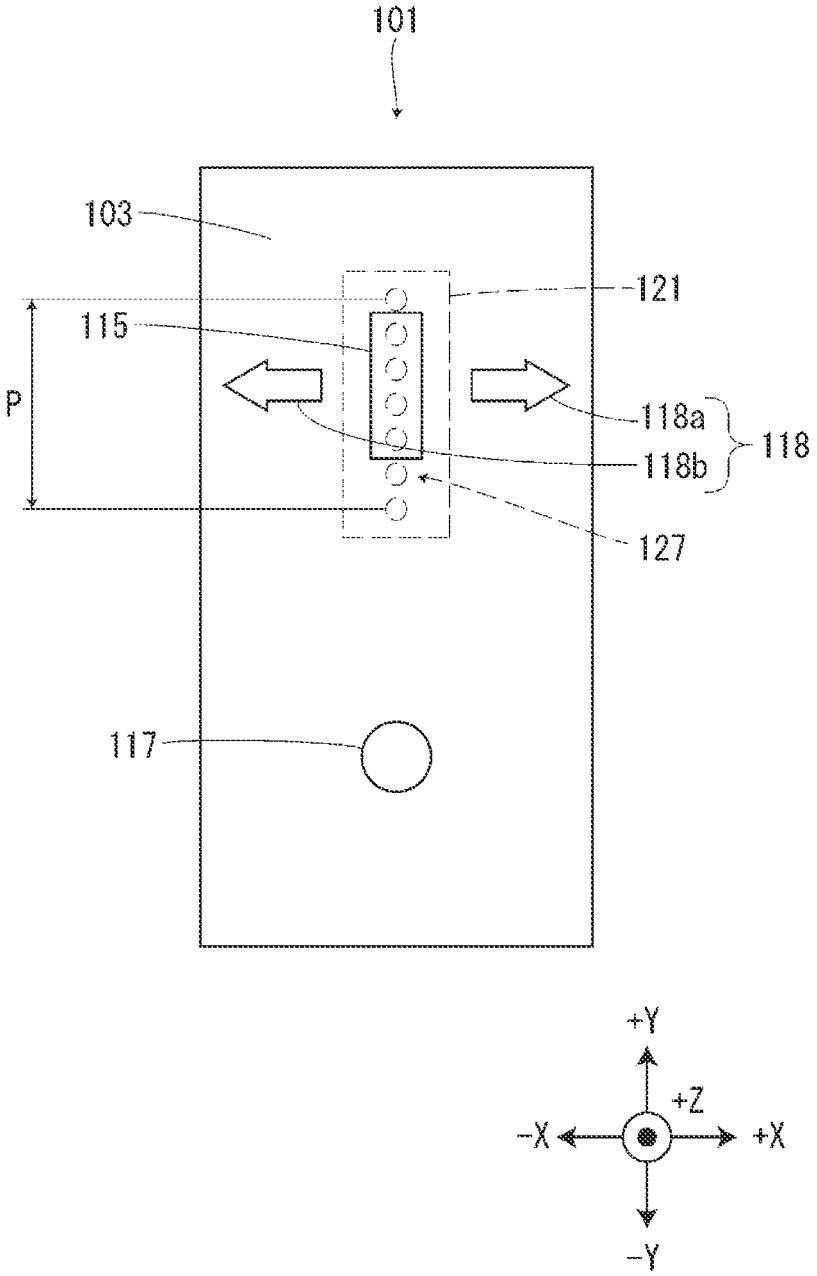
FIG. 4 shows the printer as seen from a +Z direction.

The direction indicator 118 notifies the user 301 of a direction in which the printer 101 should be moved at printing. As the direction indicator 118, e.g. an LED (Light Emitting Diode) lamp may be used. The direction indicator 118 includes a rightward direction indicator **118*a* and a leftward direction indicator 118*b*. The rightward direction indicator 118*a* is provided at a side in the +X direction relative to the print button 115 and the leftward direction indicator 118*b* is provided at a side in the −X direction relative to the print button 115. Further, the direction indicator 118 is located in a position corresponding to the print head 121 in the Y directions (see FIG. 4). Here, the direction indicator 118 located in the position corresponding to the print head 121 in the Y directions refers to the direction indicator 118 located within a range of the print head 121 in the Y directions. Thereby, the position in which the print head 121 is provided, i.e., a position of a printable range P by the print head 121 may be indicated to the user 301 by the direction indicator 118**.

On the second outer surface 105 of the printer 101, a plurality of rollers 119, the print head 121, and a movement detection sensor 125 are provided.

The plurality of rollers 119 rotate in slide contact with the medium 201, and thereby, guide the movement of the printer 101 in the X directions relative to the medium 201.

The print head 121 is an inkjet head including a nozzle row 127 in which a plurality of nozzles are arranged, and prints the print image 203 on the medium 201 by ejecting ink from the respective nozzles. The print head 121 is provided at a side in the +Y direction relative to the center portion of the second outer surface 105. That is, the print head 121 is provided at a side in the −Z direction relative to the above described print button 115. The nozzle row 127 is arranged in the Y directions.

The movement detection sensor 125 detects amounts of movement of the printer 101 in the X directions and the Y directions while the printer 101 is moved relative to the medium 201. The movement detection sensor 125 is provided at a side in the −Y direction relative to the print head 121.

The printer 101 can print the print image 203 on the medium 201 while the printer 101 is moved in the +X direction and moved in the −X direction as seen from the printer 101. Here, the printer 101 moved in the +X direction as seen from the printer 101 refers to the printer 101 moved with the third outer surface 107 forward. Further, the printer 101 moved in the −X direction as seen from the printer 101 refers to the printer 101 moved with the fourth outer surface 109 forward.

Figure 6:
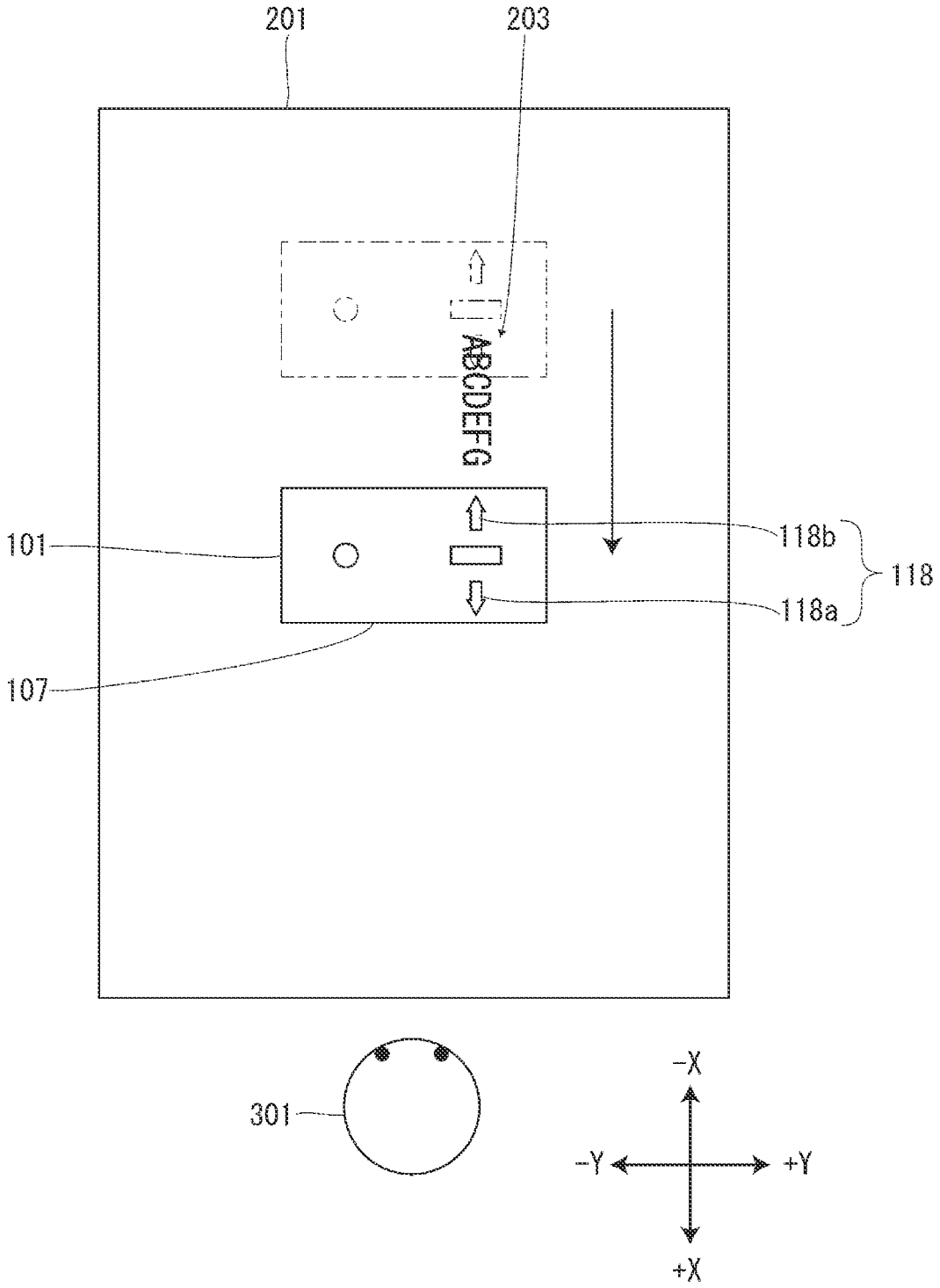
FIG. 6 shows a state in which the printer is moved in the +X direction when the user moves the printer toward the user.

For example, as shown in FIG. 5, when the user 301 moves the printer 101 to the right with the third outer surface 107 facing rightward as seen from the user 301, the printer 101 is moved with the third outer surface 107 forward and the printer 101 is moved in the +X direction as seen from the printer 101. Or, as shown in FIG. 6, when the user 301 moves the printer 101 toward the user with the third outer surface 107 facing the user as seen from the user 301, the printer 101 is moved with the third outer surface 107 forward and the printer 101 is moved in the +X direction as seen from the printer 101.

When it is hard for the printer 101 to execute one print job in a single pass, the job may be divisionally executed in a plurality of passes. Here, the pass refers to a printing operation performed while the printer 101 is moved in one direction of the +X direction or the −X direction. When one print job is divisionally executed in a plurality of passes, the user 301 may select one of a unidirectional mode and a bidirectional mode as a movement direction mode in the information processor 1.

Figure 7:
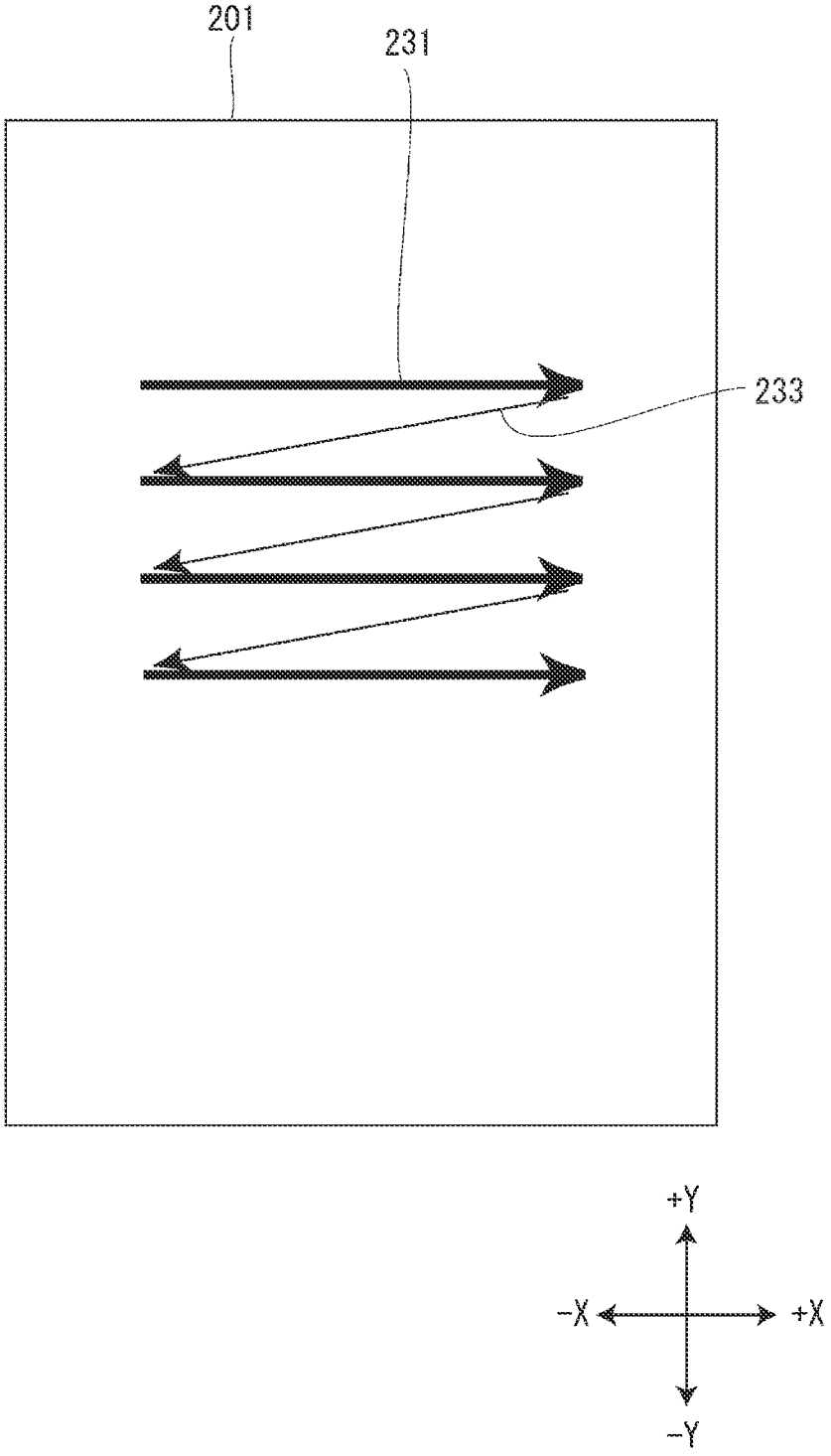
FIG. 7 shows a movement path of the printer in a unidirectional mode.
Figure 8:
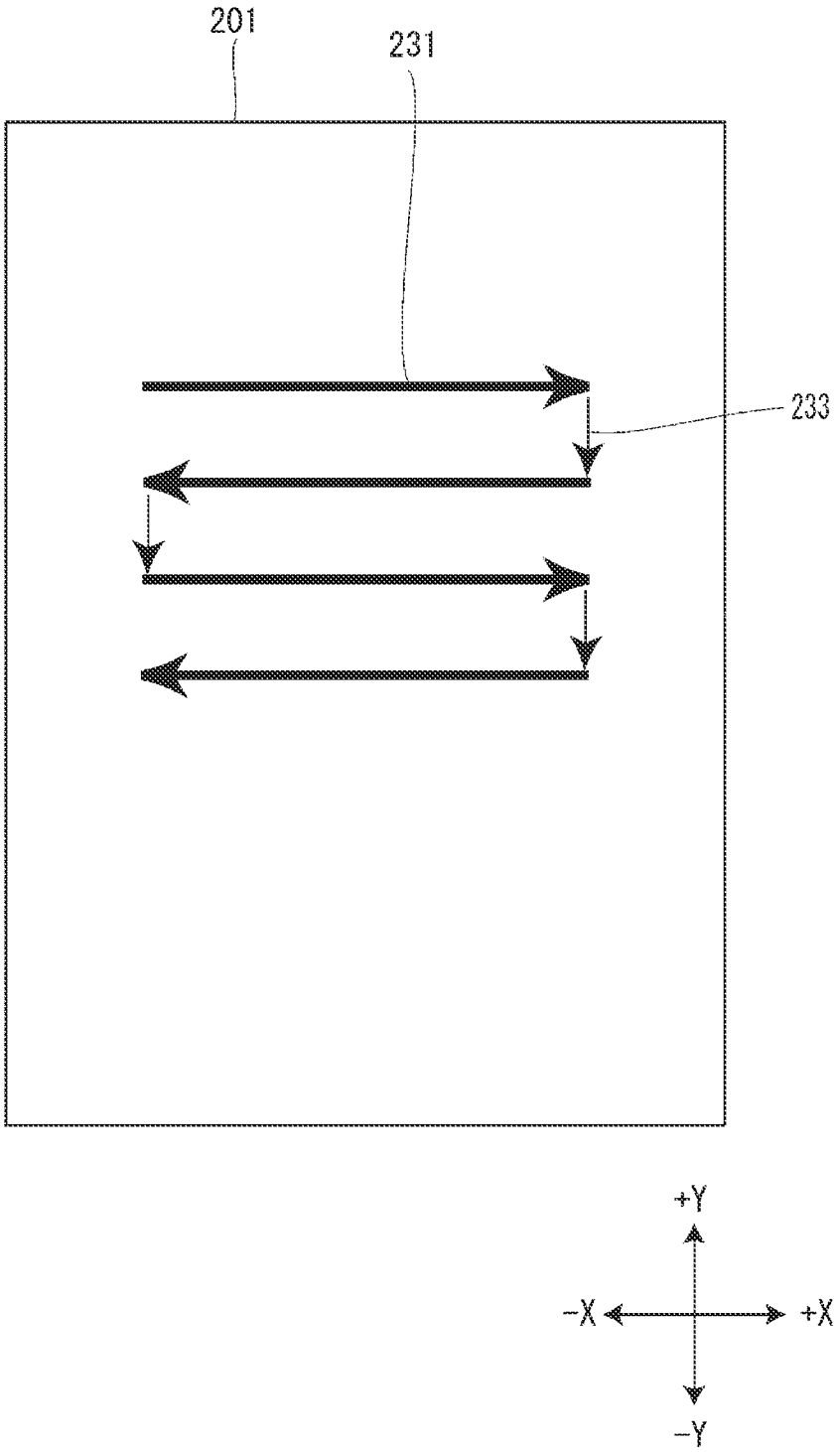
FIG. 8 shows a movement path of the printer in a bidirectional mode.

FIG. 7 shows a movement path of the printer 101 when the unidirectional mode is selected. FIG. 8 shows a movement path of the printer 101 when the bidirectional mode is selected. In the drawings, thick lines show printing movement paths 231 as the movement paths of the printer 101 at printing and thin lines show line feed movement paths 233 as the movement paths of the printer 101 at line feed. Here, "line feed" refers to the movement of the printer 101 from a movement end position of the printer 101 for one pass to a movement start position for the next pass without printing.

As shown in FIG. 7, when the unidirectional mode is selected, the printer 101 repeats an operation to perform printing for one pass while moving in the +X direction, and then, line feed in the −X direction and the −Y direction. Note that the line feed in the −X direction and the −Y direction may be movement in an oblique direction between the −X direction and the −Y direction, movement in the −X direction and movement in the −Y direction, or movement in the −Y direction and movement in the −X direction. On the other hand, as shown in FIG. 8, when the bidirectional mode is selected, the printer 101 repeats an operation to perform printing for one pass while moving in the +X direction, then, line feed in the −Y direction, and printing for the next pass while moving in the −X direction, then, line feed in the −Y direction.

Figure 9:
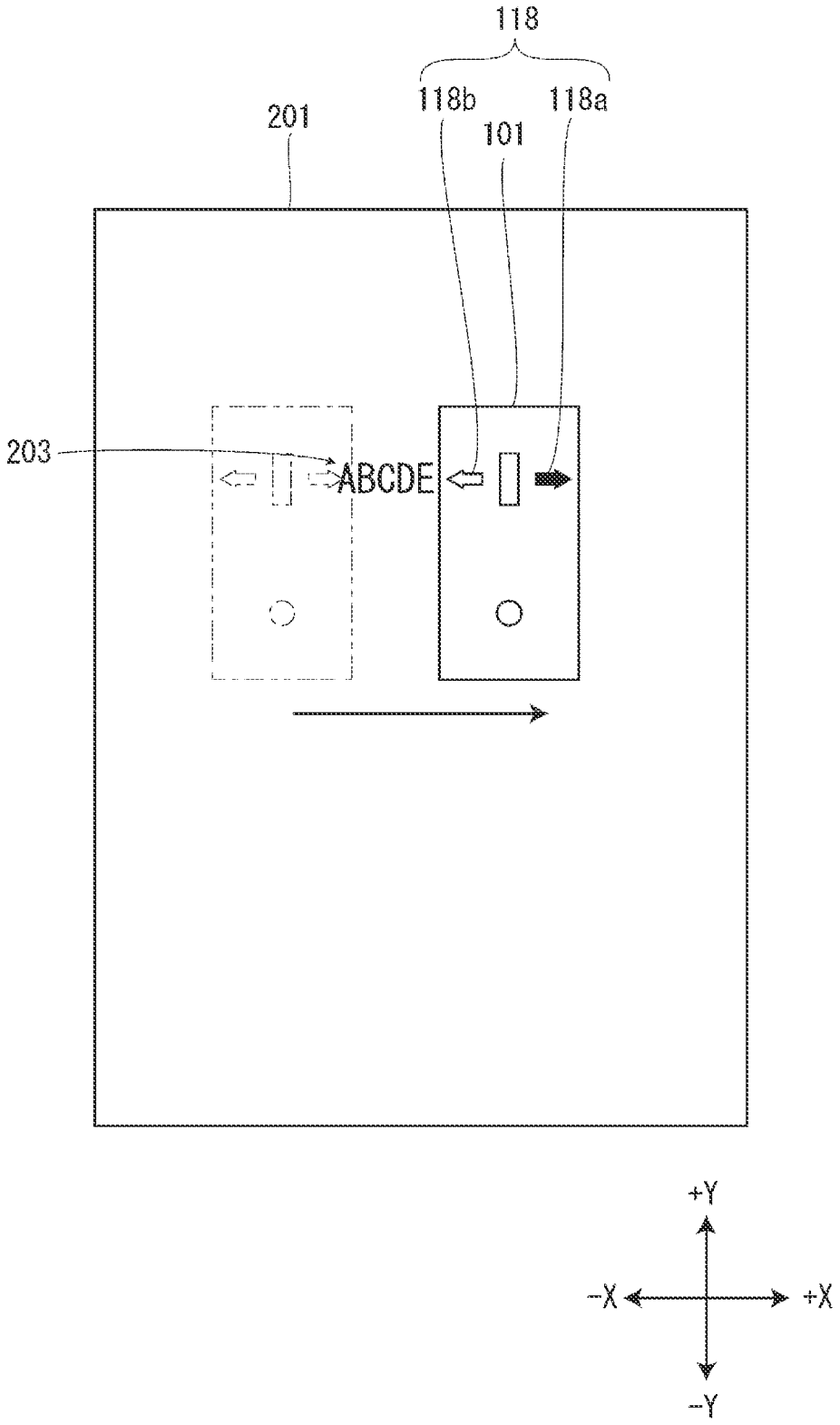
FIG. 9 shows a state during printing for a first pass in the unidirectional mode.
Figure 10:
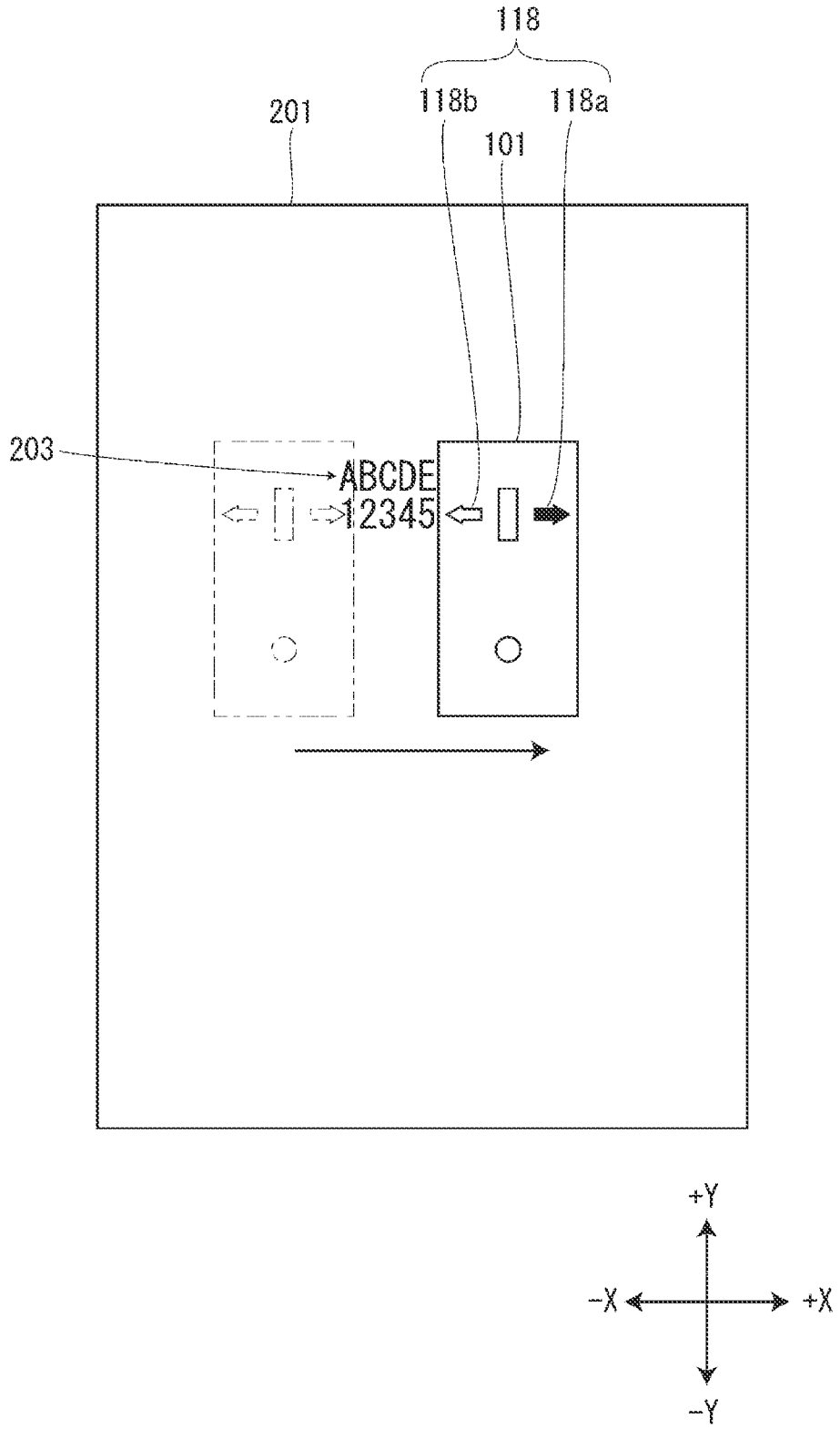
FIG. 10 shows a state during printing for a second pass in the unidirectional mode.

FIGS. 9 and 10 show states during printing of the print image 203 when the unidirectional mode is selected. As shown in FIG. 7, in the unidirectional mode, when the printer 101 divisionally executes one print job in a plurality of passes, the movement direction of the printer 101 is the +X direction in all of the plurality of passes. For example, when printing a character string "ABCDEFG" on the first line and a character string "1234567" on the second line, the printer 101 prints the character string on the first line while being moved in the +X direction (see FIG. 9) in the first pass, and prints the character string on the second line while being moved in the +X direction (see FIG. 10) in the second pass.

Figure 11:
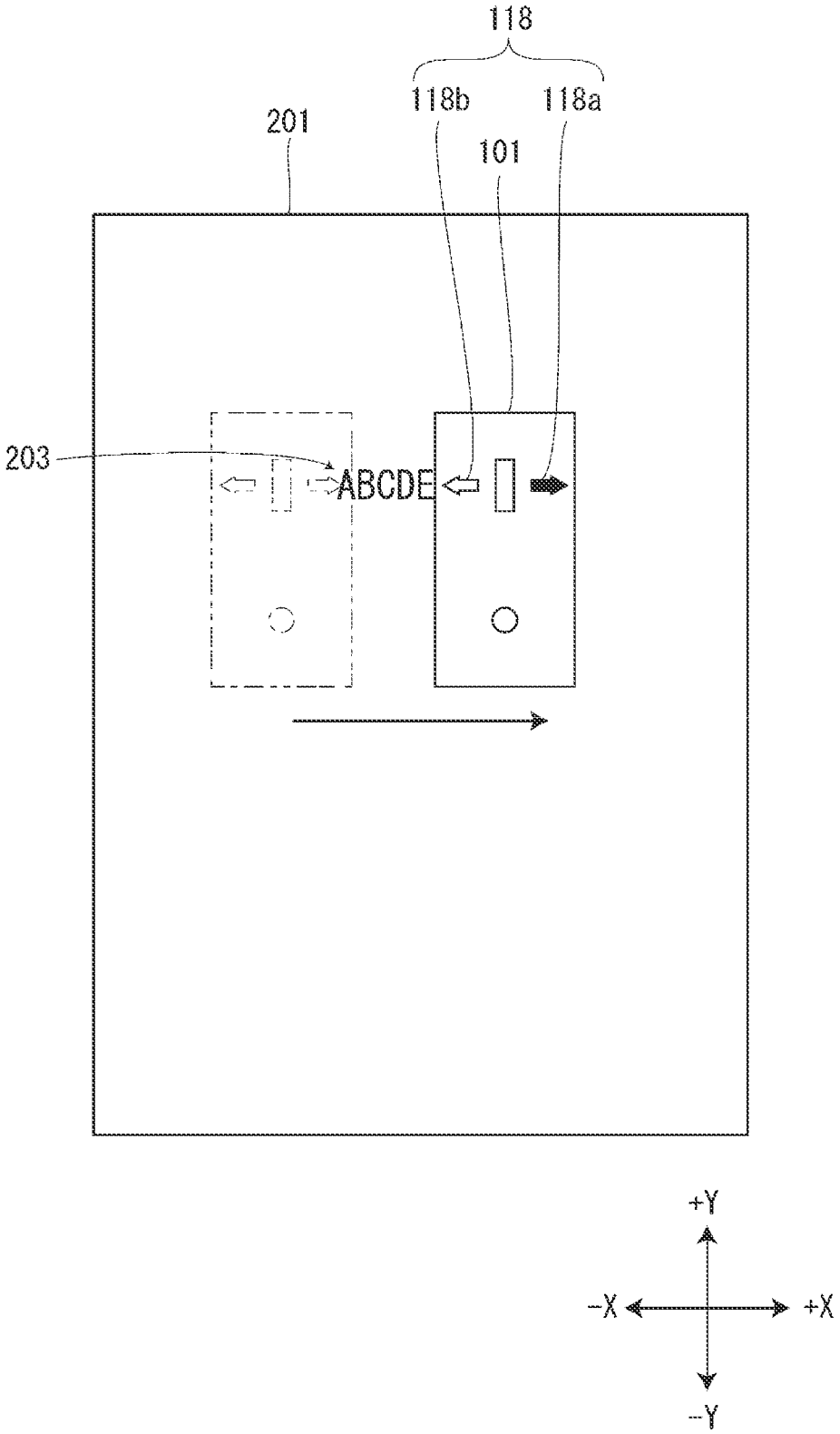
FIG. 11 shows a state during printing for a first pass in the bidirectional mode.
Figure 12:
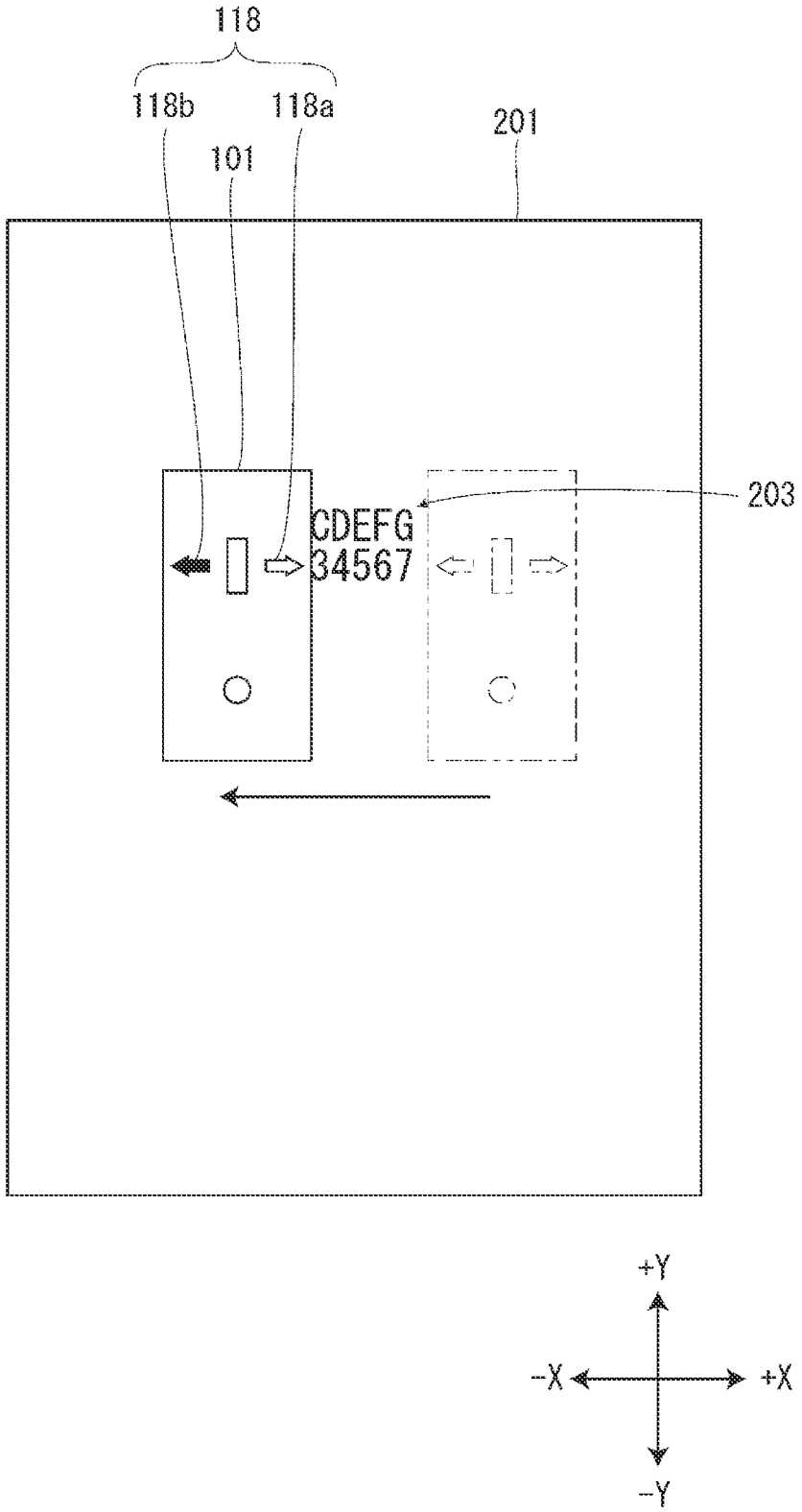
FIG. 12 shows a state during printing for a second pass in the bidirectional mode.

FIGS. 11 and 12 show states during printing of the print image 203 when the bidirectional mode is selected. As shown in FIG. 8, in the bidirectional mode, when the printer 101 divisionally executes one print job in a plurality of passes, the movement direction of the printer 101 is alternately switched with respect to each pass between the +X direction in the odd-numbered pass and the −X direction in the even-numbered pass. For example, when a character string "ABCDEFG" on the first line and a character string "1234567" on the second line are printed, the printer 101 prints the character string on the first line while being moved in the +X direction (see FIG. 11) in the first pass, and prints the character string on the second line while being moved in the −X direction (see FIG. 12) in the second pass.

The printer 101 executes one or more passes based on the print job transmitted from the information processor 1. Hereinafter, the print job divided in units of passes is referred to as "job per pass". That is, when a single print job is divisionally executed in a plurality of passes, the printer 101 executes the print job by repeating execution of the job per pass at a plurality of times.

Further, the print job designates the movement direction of the printer 101 with respect to each pass. Hereinafter, the movement direction of the printer 101 designated by the print job is referred to as "designated direction". That is, the designated directions are respectively designated for one or more jobs per pass contained in the print job. For example, in the unidirectional mode, the designated directions are designated to be the +X direction for all jobs per pass. In the bidirectional mode, the designated directions are designated to be the +X direction for the odd-numbered jobs per pass and the designated directions are designated to be the −X direction for the even-numbered jobs per pass.

The print data contained in the job per pass corresponds to the designated movement direction of the printer 101. For example, the job per pass in the designated direction designated to be the +X direction is a job in which an appropriate image is printed when the printer 101 is moved in the +X direction. The job per pass in the designated direction designated to be the −X direction is a job in which an appropriate image is printed when the printer 101 is moved in the −X direction.

Note that the printer 101 lights the direction indicator 118 indicating the +X direction, i.e., the rightward direction indicator 118*a* (see FIG. 9 to FIG. 11) while executing the job per pass in the designated direction designated to be the +X direction. The printer 101 lights the direction indicator 118 indicating the −X direction, i.e., the leftward direction indicator 118*b* (see FIG. 12) while executing the job per pass in the designated direction designated to be the −X direction.

Figure 13:
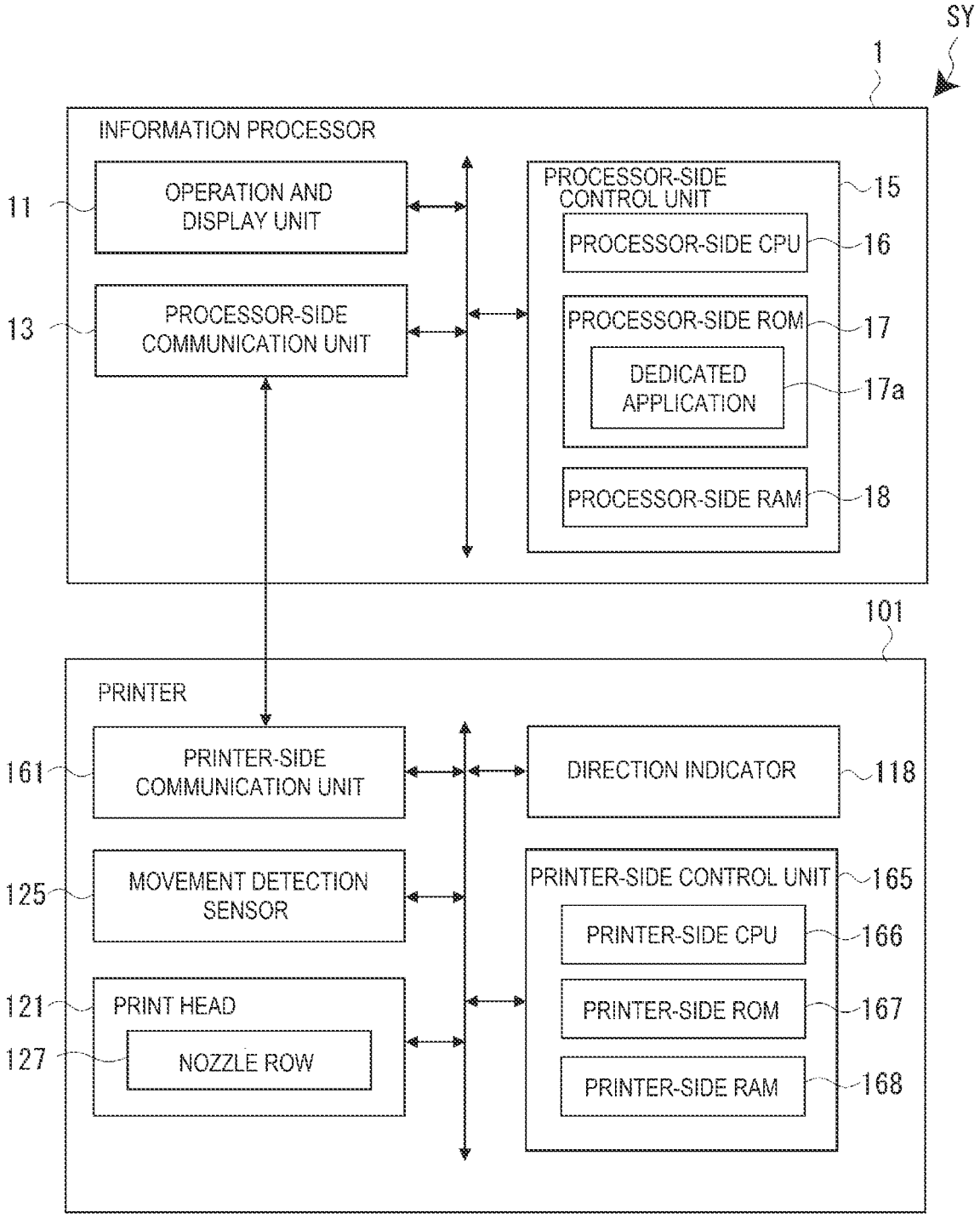
FIG. 13 is a control block diagram of a printing system of a first embodiment.

Referring to FIG. 13, a hardware configuration of the printing system SY will be explained. The printing system SY includes the information processor 1 and the printer 101. The information processor 1 includes an operation and display unit 11, a processor-side communication unit 13, and a processor-side control unit 15.

The operation and display unit 11 is e.g. a touch panel and used for various operations by the user 301 and display of various kinds of information. The operation and display unit 11 displays e.g. a print setting window 27 (see FIG. 14). In a print instruction window (not shown), the print setting window 27 is a window when information for printing the print image 203 is input and a print instruction is given.

Figure 14:
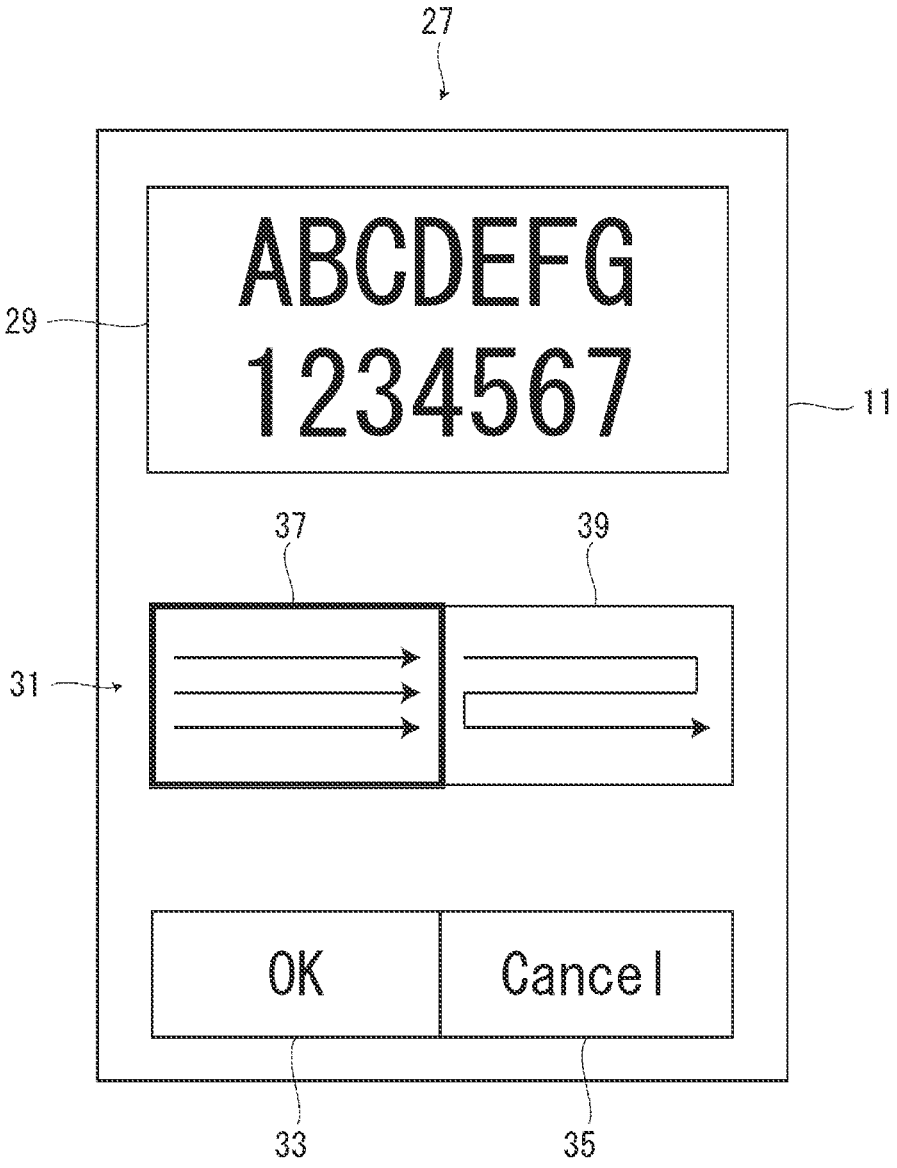
FIG. 14 shows a print setting window.

As shown in FIG. 14, in the print setting window 27, a print preview 29, a movement direction mode selection field 31, an OK button 33, and a cancel button 35 are provided.

In the print preview 29, a preview of the print image 203 is displayed based on the information input in the print instruction window.

In the movement direction mode selection field 31, a unidirectional mode option 37 and a bidirectional mode option 39 are selectively displayed. Note that, when the print image 203 may be executed in a single pass, only the unidirectional mode option 37 may be set to be selective, but the bidirectional mode option 39 may be set to be non-selective.

The OK button 33 receives an operation for fixing the selection in the print setting window 27. When receiving the operation of the OK button 33, the information processor 1 generates a print job and transmits the generated print job to the printer 101. The cancel button 35 receives an operation to cancel the selection in the print setting window 27. When receiving the operation of the cancel button 35, the information processor 1 undisplays the print setting window 27 and displays the print instruction window.

Returning to the explanation of FIG. 13, the processor-side communication unit 13 communicates with the printer 101 via wireless connection or the like. For example, the processor-side communication unit 13 transmits the print job to the printer 101.

The processor-side control unit 15 includes a processor-side CPU (Central Processing Unit) 16, a processor-side ROM (Read Only Memory) 17, and a processor-side RAM (Random Access Memory) 18.

The processor-side CPU 16 performs various kinds of control by developing and executing various control programs stored in the processor-side ROM 17 in the processor-side RAM 18. Note that the processor-side control unit 15 may use a hardware circuit such as an ASIC (Application Specific Integrated Circuit) as a processor in place of the processor-side CPU 16. Or, the processor may have a configuration in which one or more CPUs and a hardware circuit such as an ASIC cooperatively operate.

The processor-side ROM 17 is a rewritable ROM such as a flash memory and stores various control programs and various control data. The processor-side RAM 18 is used as a work area for various kinds of control by the processor-side CPU 16.

The processor-side ROM 17 stores a dedicated application 17*a* for control of the printer 101. The processor-side CPU 16 displays the above described print setting window 27 using the dedicated application 17*a*.

Further, the processor-side CPU 16 generates the print job using the dedicated application 17*a*. More specifically, the processor-side CPU 16 generates the print job using the information input in the print instruction window and the movement direction mode selected in the print setting window 27.

The printer 101 includes a printer-side communication unit 161, the movement detection sensor 125, the print head 121, the direction indicator 118, and a printer-side control unit 165. The direction indicator 118 is an example of "direction notification unit". The printer-side control unit 165 is an example of "job acquisition unit".

The printer-side communication unit 161 communicates with the information processor 1 via wireless connection or the like.

The movement detection sensor 125 optically reads minute concavities and convexities of the medium 201 and outputs a movement detection signal while the printer 101 is moved relative to the medium 201.

The print head 121 has the nozzle row 127 in which a plurality of nozzles are arranged. The print head 121 performs printing on the medium 201 by ejecting ink from the plurality of nozzles.

The direction indicator 118 notifies the user 301 of the designated direction designated for each job per pass. More specifically, the direction indicator 118 notifies the user 301 of the designated direction designated for the job per pass as an object to be printed before the movement of the printer 101 is started. Further, the direction indicator 118 is switched from the on state to the off state when the movement of the printer 101 for one pass is ended, that is, when printing of the job per pass is ended.

The printer-side control unit 165 includes a printer-side CPU 166, a printer-side ROM 167, and a printer-side RAM 168.

The printer-side CPU 166 performs various kinds of control by developing and executing various control programs stored in the printer-side ROM 167 in the printer-side RAM 168. Note that the printer-side control unit 165 may use a hardware circuit such as an ASIC (Application Specific Integrated Circuit) as a processor in place of the printer-side CPU 166. Or, the processor may have a configuration in which one or more CPUs and a hardware circuit such as an ASIC cooperatively operate.

The printer-side ROM 167 stores various control programs and various control data. The printer-side RAM 168 is used as a work area for various kinds of control by the printer-side CPU 166.

The printer-side CPU 166 calculates movement distances of the printer 101 in the X directions and the Y directions based on the movement detection signal output from the movement detection sensor 125. Further, the printer-side CPU 166 controls the print head 121 based on the calculated movement distances in the X directions and the Y directions to print the print image 203 on the medium 201. More specifically, the printer-side CPU 166 ejects the ink from the respective nozzle rows contained in the nozzle row 127 at times based on the calculated movement distance in the X directions. Thereby, the printer 101 may appropriately print the print image 203 on the medium 201 independent of the speed of the printer 101 moved in the X directions by the user 301.

Furthermore, the printer-side CPU 166 controls lighting of the direction indicator 118 based on the designated direction designated for the job per pass. For example, the printer-side CPU 166 turns on the rightward direction indicator 118*a* and turns off the leftward direction indicator 118*b* while the job per pass in the designated direction designated to be the +X direction is printed. The printer-side CPU 166 turns on the leftward direction indicator 118*b* and turns off the rightward direction indicator 118*a* while the job per pass in the designated direction designated to be the −X direction is printed.

Figure 15:
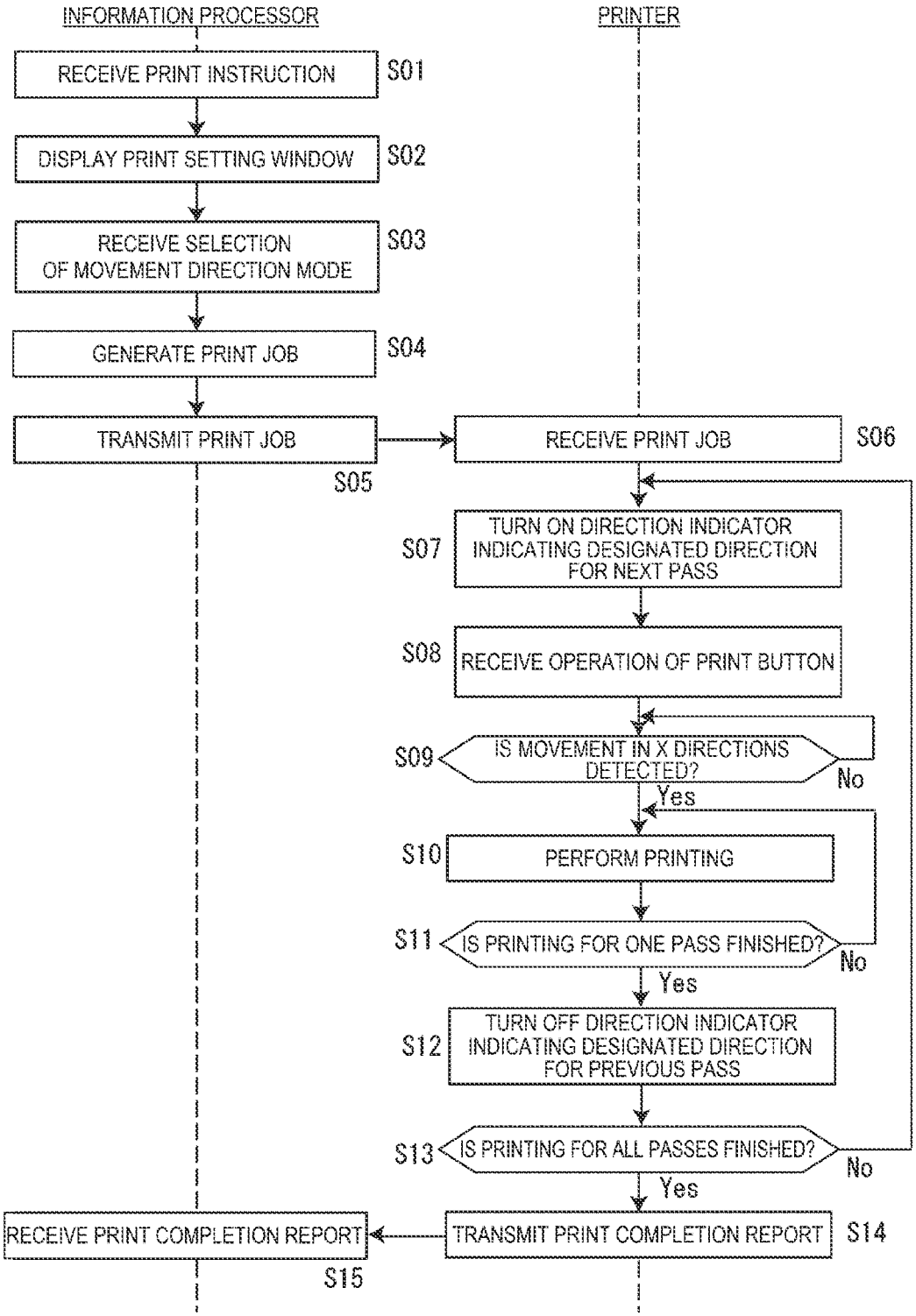
FIG. 15 is a flowchart showing print control processing executed by an information processor and print processing executed by the printer of the first embodiment.

Referring to FIG. 15, print control processing executed by the information processor 1 and print processing executed by the printer 101 of the first embodiment will be explained.

At step S01, the information processor 1 receives a print instruction in the print instruction window (not shown).

At step S02, the information processor 1 displays the print setting window 27 on the operation and display unit 11.

At step S03, the information processor 1 receives selection of the movement direction mode in the print setting window 27.

At step S04, the information processor 1 generates a print job containing one or more jobs per pass based on the information input to the print instruction window and a selection result of the movement direction mode received at step S03.

At step S05, the information processor 1 transmits the print job generated at step S04 to the printer 101.

At step S06, the printer 101 receives the print job transmitted from the information processor 1.

At step S07, the printer 101 turns on the direction indicator 118 indicating the designated direction for the next pass, i.e., the direction indicator 118 corresponding to the designated direction designated for the job per pass to be printed next. For example, the printer 101 turns on the rightward direction indicator 118*a* when the unidirectional mode is selected. The printer 101 turns on the rightward direction indicator 118*a* when the bidirectional mode is selected and the next pass is an odd-numbered pass. The printer 101 turns on the leftward direction indicator 118*b* when the bidirectional mode is selected and the next pass is an even-numbered pass.

At step S08, the printer 101 receives an operation of the print button 115 by the user 301. The operation of the print button 115 refers to an operation of shortly pressing the print button 115.

At step S09, the printer 101 determines whether or not the movement of the printer 101 in the X directions is detected by the movement detection sensor 125. When determining that the movement of the printer 101 in the X directions is detected, the printer 101 moves to step S10. Or, when determining that the movement of the printer 101 in the X directions is not detected, the printer 101 repeats step S09.

At step S10, the printer 101 performs printing by controlling the print head 121.

At step S11, the printer 101 determines whether or not printing for one pass is finished. When determining that the printing for one pass is finished, the printer 101 moves to step S12. Or, when determining that the printing for one pass is not finished, the printer 101 returns to step S10.

At step S12, the printer 101 turns off the direction indicator 118 indicating the designated direction of the previous pass, i.e., the pass for which printing is finished at step S11.

At step S13, the printer 101 determines whether or not printing for all passes is finished. When determining that printing for all passes is finished, the printer 101 moves to step S14. Or, when determining that printing for all passes is not finished, the printer 101 returns to step S07.

At step S14, the printer 101 transmits a print completion report representing that the printing is completed to the information processor 1.

At step S15, the information processor 1 receives the print completion report transmitted from the printer 101.

As described above, the printer 101 of the first embodiment notifies the user 301 of the designated direction as the movement direction of the printer 101 designated by the print job before starting the movement. Accordingly, the user 301 may appropriately print the print image 203 by moving the printer 101 in the designated direction notified of.

Further, the printer 101 of the first embodiment ends the notification of the designated direction when the movement of the printer 101 for the single pass is finished. Accordingly, the user 301 may know that the movement of the printer 101 for the single pass is finished.

Note that, in the first embodiment, the following modified examples can be employed.

Modified Example 1-1

Figure 16:
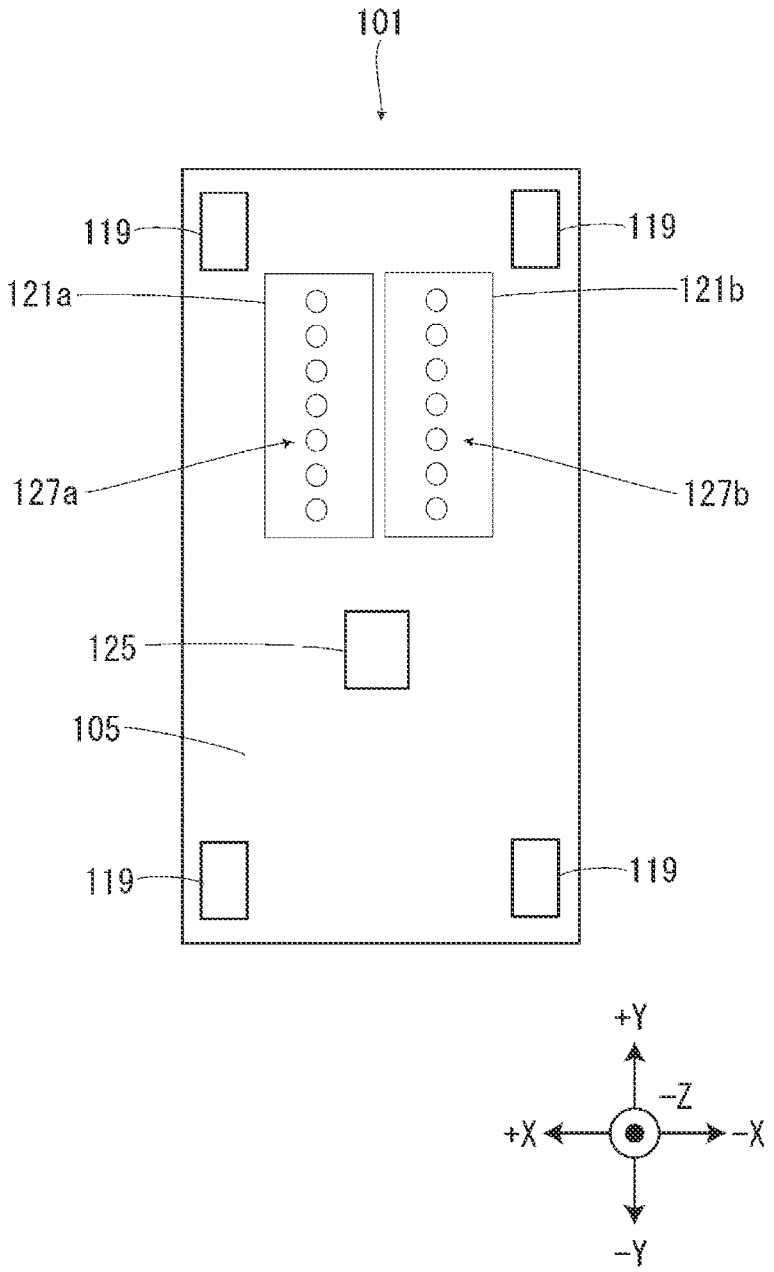
FIG. 16 shows a printer having two print heads as seen from a −Z direction.

The printer 101 of the above described embodiment includes the single print head 121, but may include two print heads 121. FIG. 16 shows a printer 101 of this modified example as seen from the −Z direction. The printer 101 of the modified example includes a first print head 121*a* and a second print head 121*b* provided at a side in the −X direction relative to the first print head 121*a*. The first print head 121*a* has a first nozzle row 127*a*. The second print head 121*b* has a second nozzle row 127*b*. The first nozzle row 127*a* and the second nozzle row 127*b* are provided in parallel and apart in the X directions. Further, the first nozzle row 127*a* and the second nozzle row 127*b* have the same number of nozzles and distances between the nozzles and are placed in the same position of the second outer surface 105 in the Y directions.

Note that the ink ejected from the nozzles of the first nozzle row 127*a* and the ink ejected from the nozzles of the second nozzle row 127*b* may be the same ink or different inks. For example, the printer 101 may perform multicolor printing by ejecting a black ink from the nozzles of the first nozzle row 127*a* and ejecting a red ink from the nozzles of the second nozzle row 127*b*.

In the above described configuration, when performing printing using both the first nozzle row 127*a* and the second nozzle row 127*b*, the printer 101 delays the time to end the notification of the designated direction by the direction indicator 118 to be later than that when performing printing using one of the first nozzle row 127*a* and the second nozzle row 127*b*.

Figure 17:
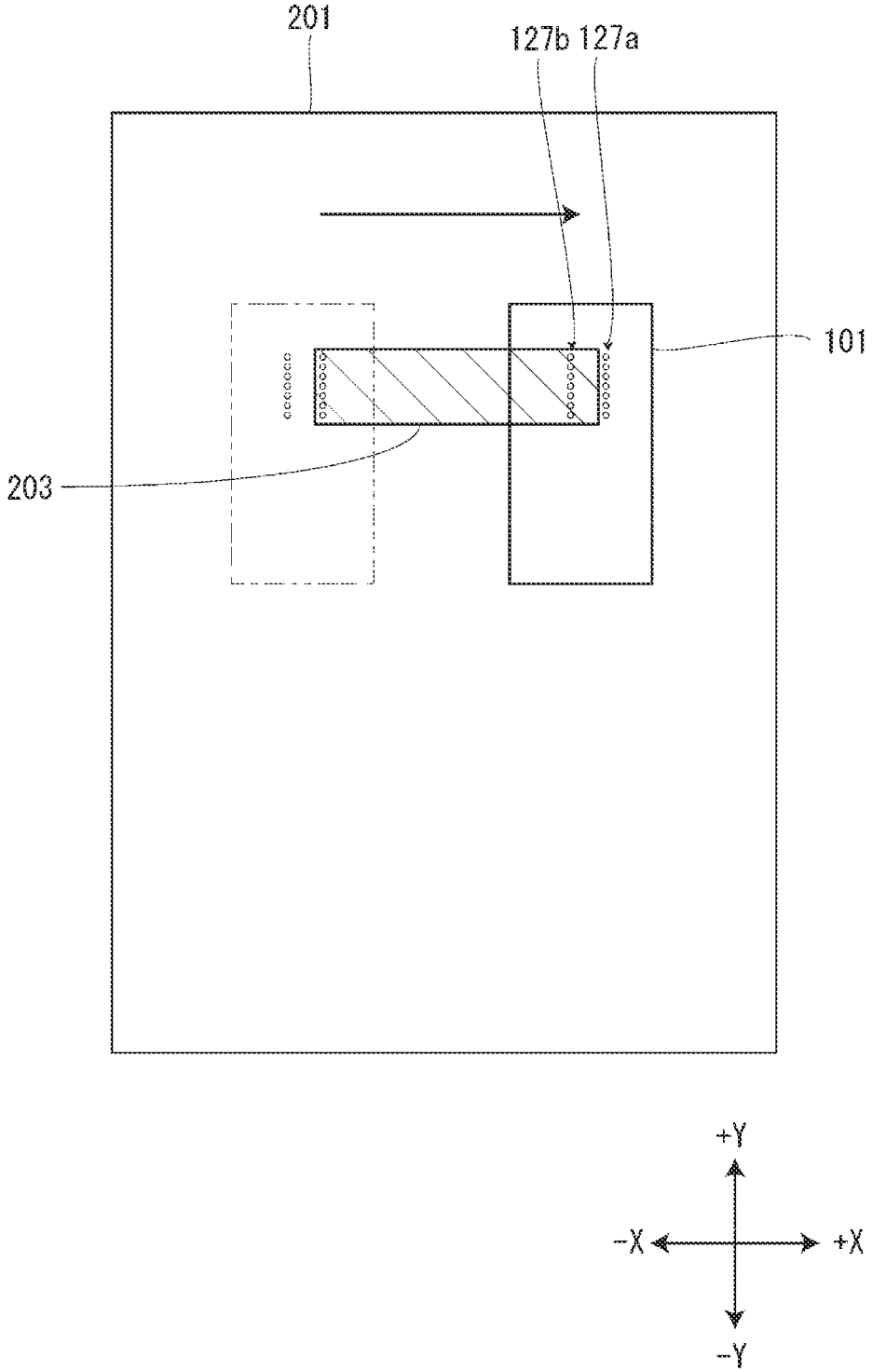
FIG. 17 shows a movement range of the printer when printing using one of the two print heads is performed.

FIG. 17 shows a movement range of the printer 101 in the X directions when printing using only the first nozzle row 127*a* of the first nozzle row 127*a* and the second nozzle row 127*b* is performed. When performing printing of the print image 203 using only the first nozzle row 127*a*, the printer 101 notifies the user of the designated direction by the direction indicator 118 from the start of printing of the print image 203 by the first nozzle row 127*a* to the end of printing of the print image 203 by the first nozzle row 127*a*.

Figure 18:
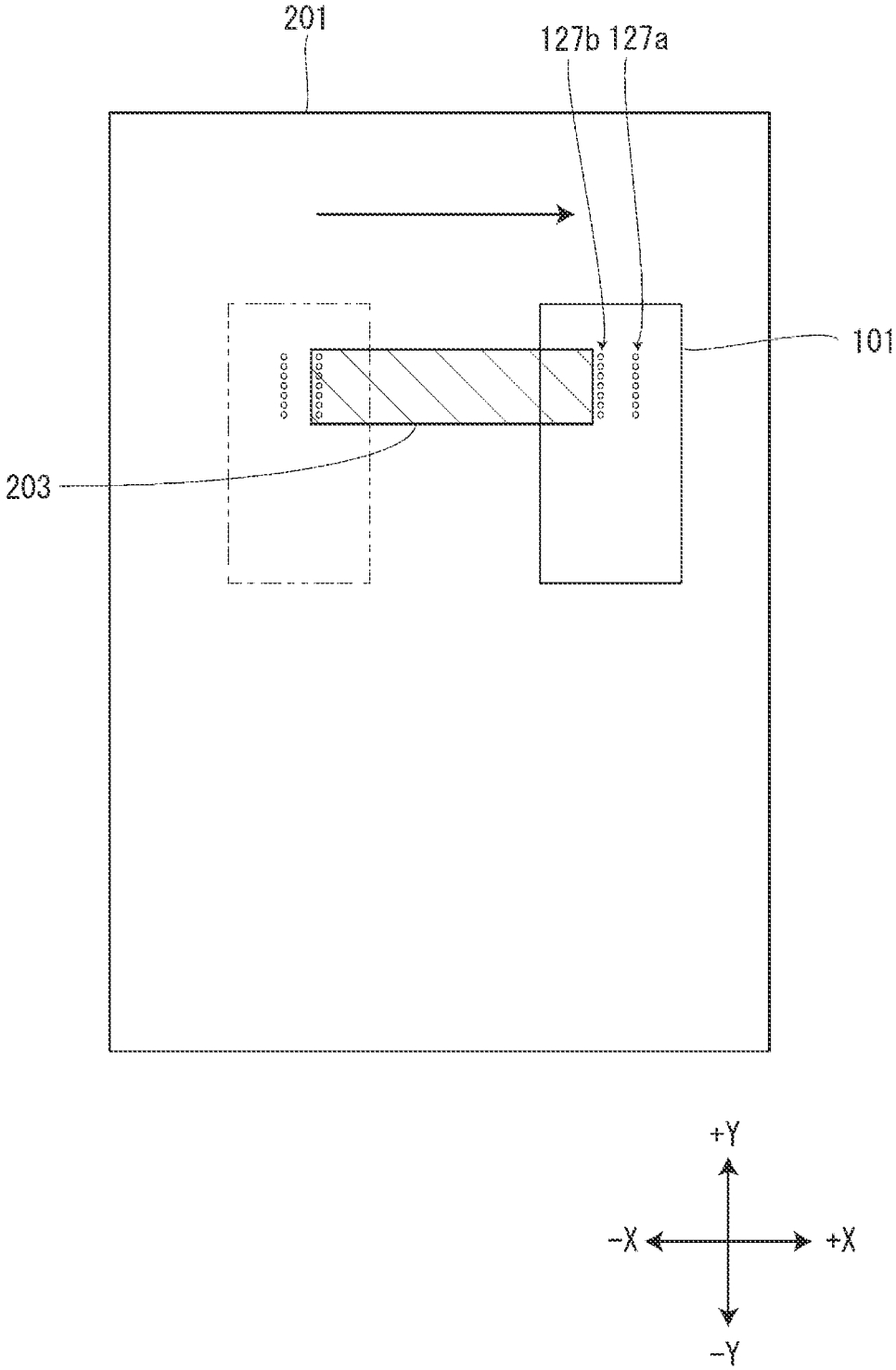
FIG. 18 shows a movement range of the printer when printing using both of the two print heads is performed.

On the other hand, FIG. 18 shows a movement range of the printer 101 in the X directions when printing using both the first nozzle row 127*a* and the second nozzle row 127*b* is performed. When performing printing of the print image 203 using the first nozzle row 127*a* and the second nozzle row 127*b*, the printer 101 notifies the user of the designated direction by the direction indicator 118 from the start of printing of the print image 203 by the first nozzle row 127*a* to the end of printing of the print image 203 by the second nozzle row 127*b*.

As described above, when printing using both the first nozzle row 127*a* and the second nozzle row 127*b* is performed, the printer 101 delays the time to end the notification of the designated direction to be later than that when performing printing using only the first nozzle row 127*a* by the time taken for movement over the distance between the first nozzle row 127*a* and the second nozzle row 127*b*. According to the configuration, the printer 101 may notify the user of the designated direction in an appropriate period according to whether to use both the first nozzle row 127*a* and the second nozzle row 127*b* or use one of the rows.

Note that, as another modified example, the first nozzle row 127*a* and the second nozzle row 127*b* may be provided on a common print head 121, not respectively provided in the different print heads 121.

Modified Example 1-2

The printer 101 of the above described embodiment turns on the direction indicator 118 when receiving the print job, however, may turn on the direction indicator 118 when receiving an operation of the print button 115 or after receiving the operation of the print button 115.

Modified Example 1-3

The printer 101 of the above described embodiment turns off the direction indicator 118 when printing for the single pass is finished, however, may turn off the direction indicator 118 when receiving an operation of the print button 115 to instruct the start of printing in the next pass.

Further, as another modified example, the printer 101 may turn off the direction indicator 118 after a predetermined time elapses from the start of lighting of the direction indicator 118.

When printing is performed with the print button 115 pressed and held, the printer 101 may turn off the direction indicator 118 when the pressed print button 115 is released.

Second Embodiment

Next, a second embodiment will be explained. A printer 101 of the second embodiment is different from the printer 101 of the first embodiment in that a line feed indicator 131 is provided. As below, only the differences from the first embodiment will be explained. Note that, in the embodiment, the same component parts as those of the first embodiment have the same signs and the detailed explanation thereof will be omitted. Further, modified examples applied to the component parts as those of the first embodiment are applied to this embodiment.

Figure 19:
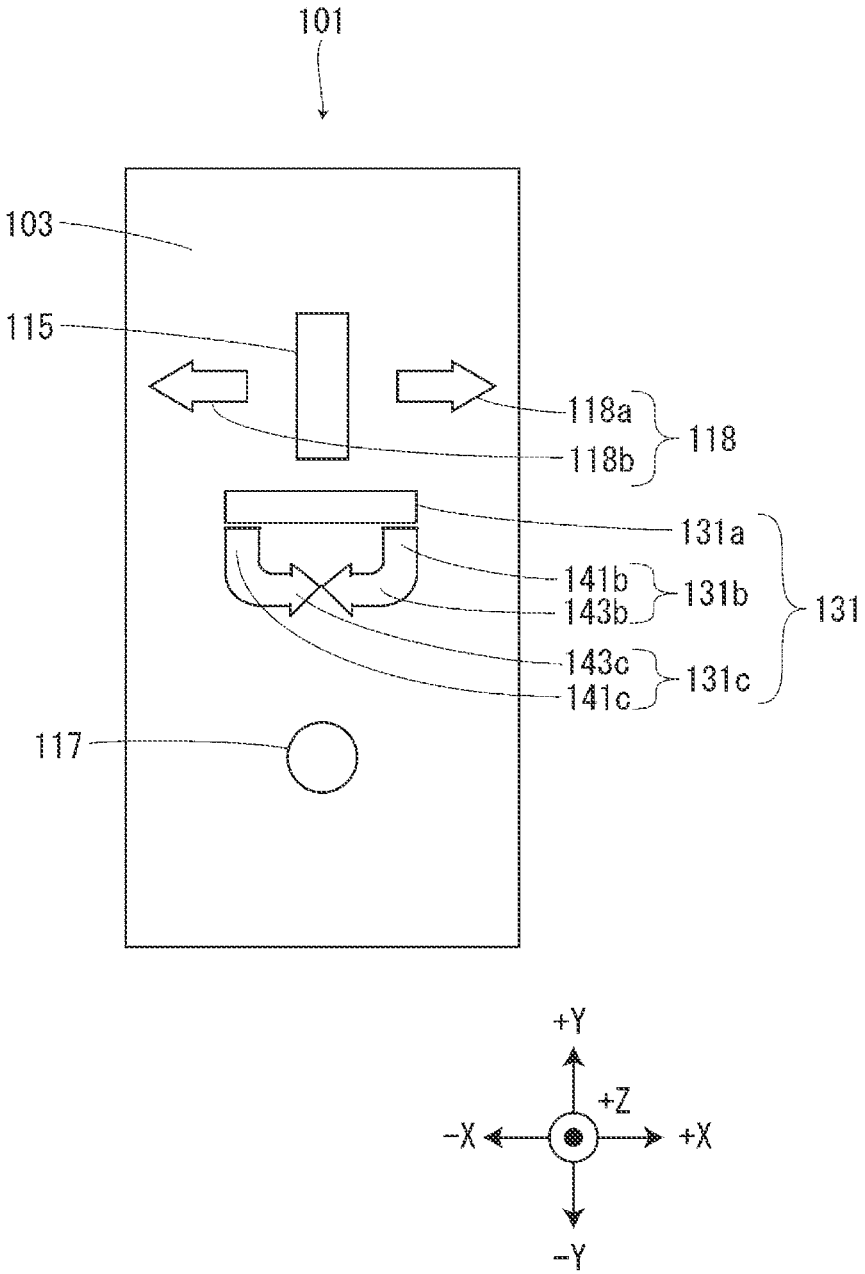
FIG. 19 shows a printer of a second embodiment as seen from the +Z direction.

FIG. 19 shows the printer 101 of the second embodiment as seen from the +Z direction. The line feed indicator 131 is provided at a side in the −Y direction relative to the print button 115 and at a side in the +Y direction relative to the power button 117 on the first outer surface 103. After the movement of the printer 101 for one pass is ended and before the movement for the next pass is started, the line feed indicator 131 notifies the user 301 to perform line feed as movement of the printer 101 from the movement end position of the printer 101 for one pass to the movement start position for the next pass.

The line feed indicator 131 includes a linear indicator 131*a* extending in the X directions, an inverted L-shaped first bending indicator 131*b* starting from an end of the linear indicator 131*a* in the +X direction, and an L-shaped second bending indicator 131*c* starting from an end of the linear indicator 131*a* in the −X direction. The first bending indicator 131*b* has a first main body portion 141*b* extending in the Y directions and a first arrow portion 143*b* extending in the −X direction from an end of the first main body portion 141*b* in the −Y direction. The second bending indicator 131*c* has a second main body portion 141*c* extending in the Y directions and a second arrow portion 143*c* extending in the +X direction from an end of the second main body portion 141*c* in the −Y direction. The linear indicator 131*a*, the first bending indicator 131*b*, and the second bending indicator 131*c* are arranged in an annular form.

Figure 20:
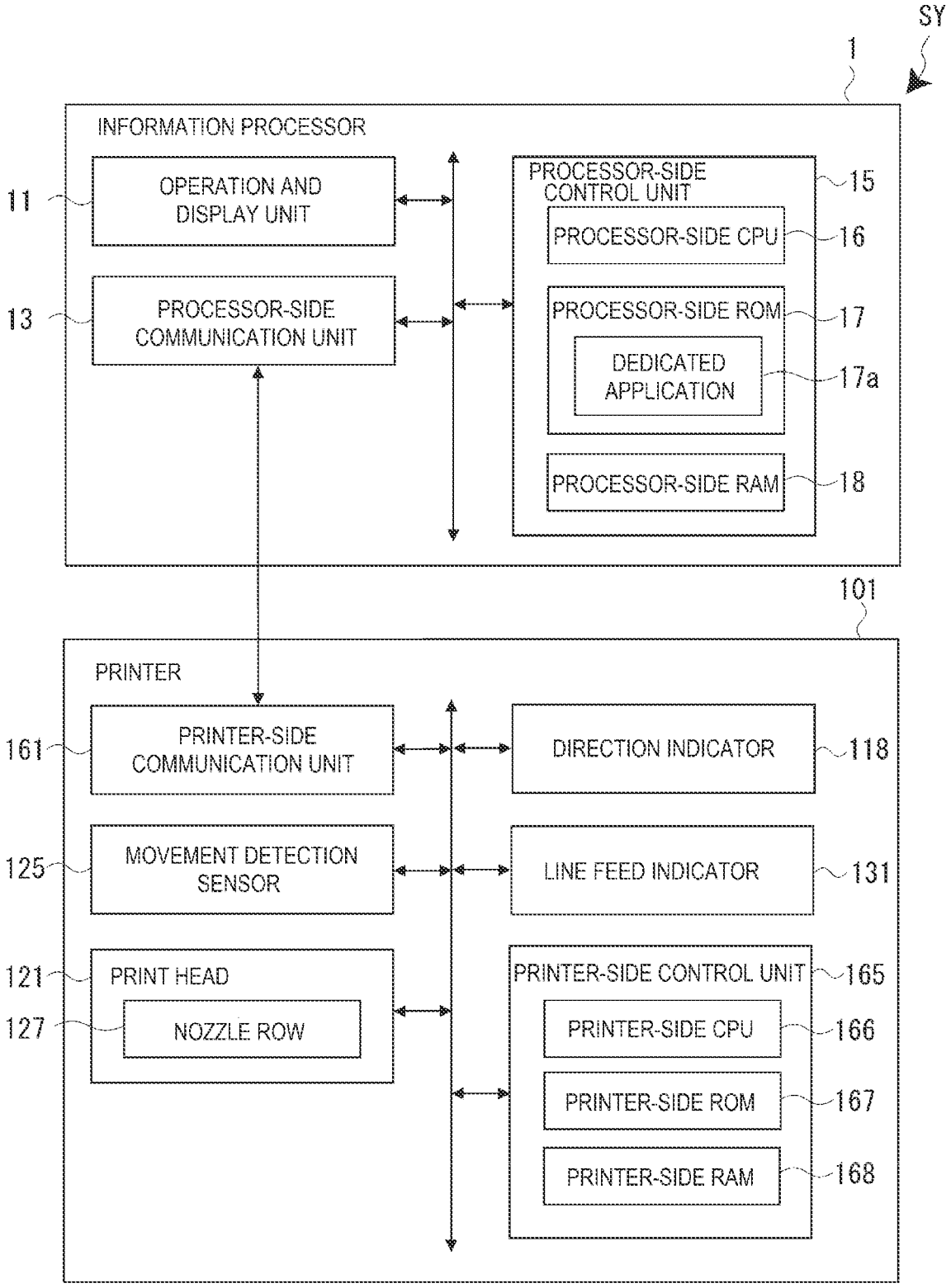
FIG. 20 is a control block diagram of a printing system of the second embodiment.

FIG. 20 is a control block diagram of a printing system SY of the second embodiment. The printer 101 of the second embodiment has a configuration in which the line feed indicator 131 is added to the hardware configuration of the printer 101 of the first embodiment (see FIG. 13). For the line feed indicator 131, lighting control is performed by the printer-side control unit 165. The line feed indicator 131 is an example of "line feed notification unit".

The line feed indicator 131 notifies the user 301 to perform line feed by switching from the turn-off state to the turn-on state after the movement of the printer 101 for one pass is ended and before the movement for the next pass is started.

Further, the line feed indicator 131 notifies the user 301 of a line feed direction as a direction in which the printer 101 is moved for line feed based on the designated direction for each pass designated by the print job. The line feed indicator 131 configures a first line feed direction notification part that notifies the user of the line feed direction when the unidirectional mode is selected and a second line feed direction notification part that notifies the user of the line feed direction when the bidirectional mode is selected. When the unidirectional mode is selected, the printer 101 is moved as shown in FIG. 7 and line feed is performed as shown by the line feed movement path 233. Or, when the bidirectional mode is selected, the printer 101 is moved as shown in FIG. 8 and line feed is performed as shown by the line feed movement path 233.

The first line feed direction notification part notifies the user 301 of the line feed direction by simultaneously lighting the linear indicator 131*a* and the second bending indicator 131*c*. Further, the second line feed direction notification part notifies the user of the line feed direction by switching and lighting one of the first bending indicator 131*b* and the second bending indicator 131*c* for each pass.

Figure 21:
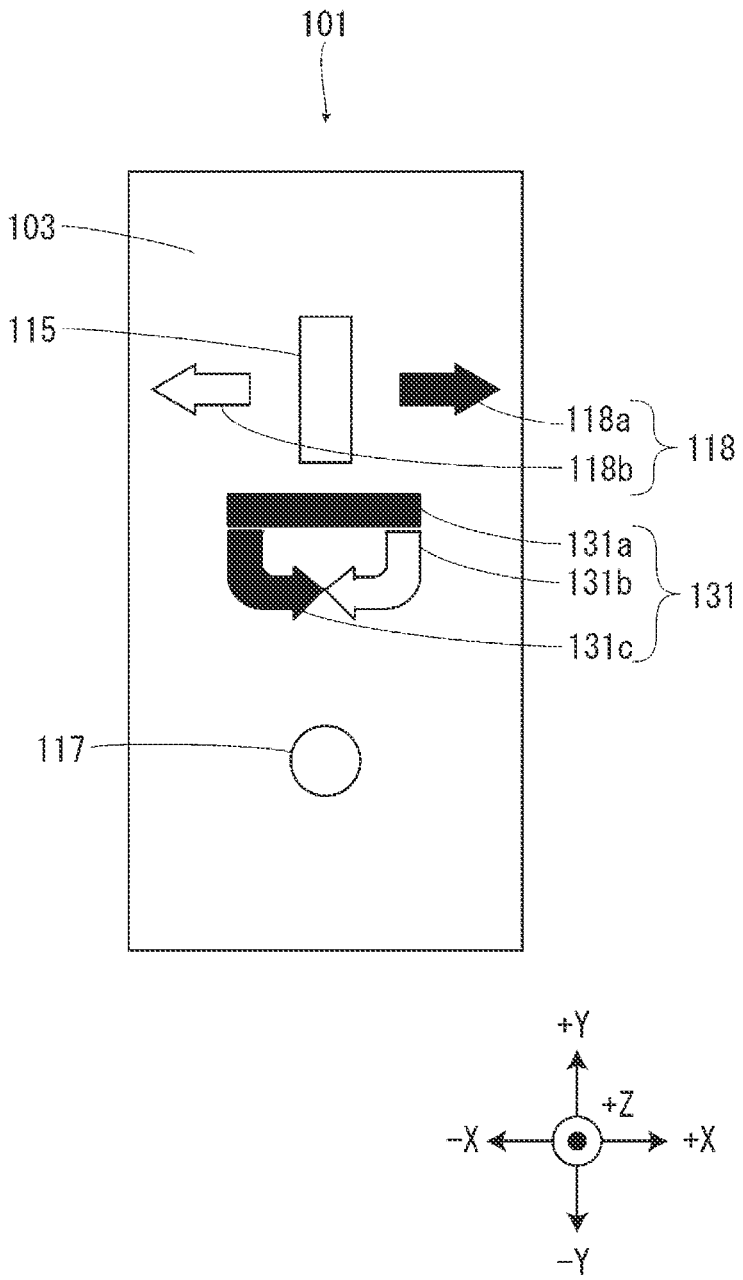
FIG. 21 shows an example of lighting states of a direction indicator and a line feed indicator.

FIG. 21 shows states of the direction indicator 118 and the line feed indicator 131 when the unidirectional mode is selected and printing is performed in a plurality of passes, and when the printing of the other passes than the final pass is finished. As shown in the drawing, the linear indicator 131*a* and the second bending indicator 131*c* are turned on, and thereby, the line feed direction in which the printer 101 is moved in the −Y direction after the printer 101 is moved in the −X direction and the +X direction as the designated direction for the next pass are shown. Further, the rightward direction indicator 118*a* is turned on, and thereby, the +X direction as the designated direction for the next pass is shown.

Figure 22:
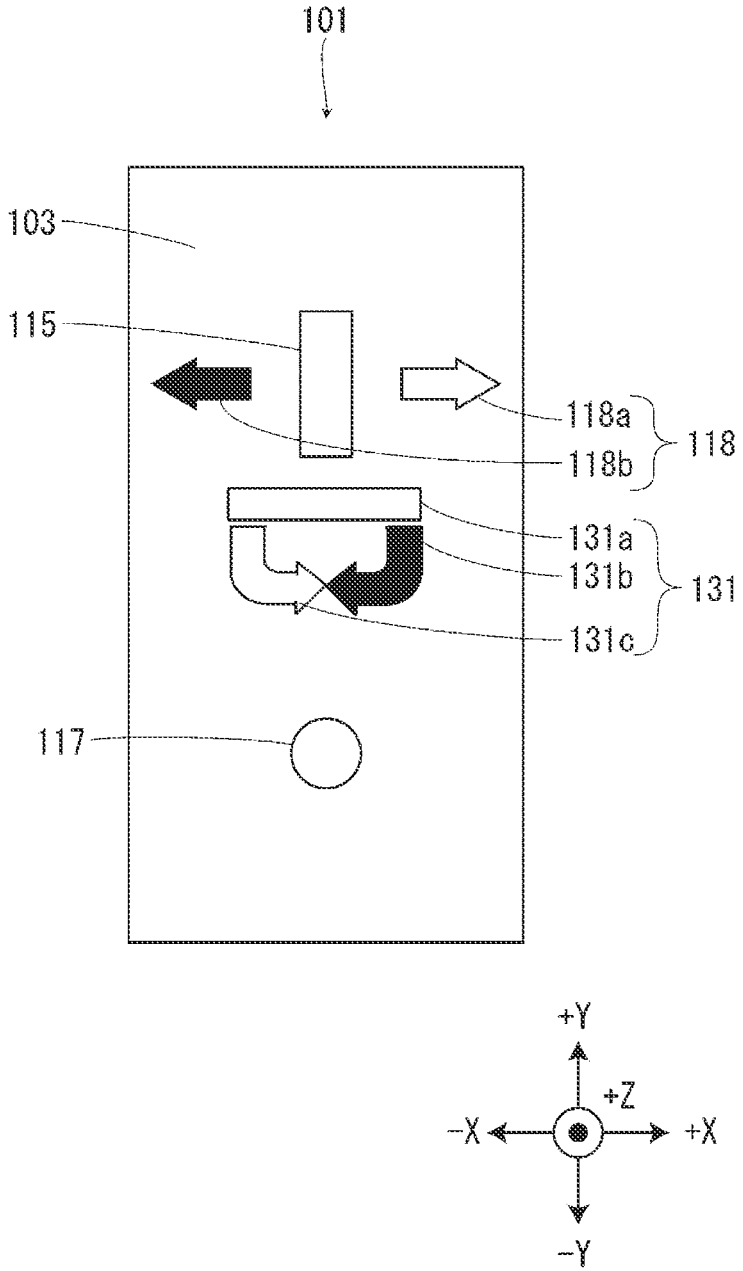
FIG. 22 shows an example of lighting states of the direction indicator and the line feed indicator different from FIG. 21.

FIG. 22 shows states of the direction indicator 118 and the line feed indicator 131 when the bidirectional mode is selected and printing is performed in a plurality of passes, and when the printing of the other odd-numbered passes than the final pass is finished. As shown in the drawing, the first bending indicator 131*b* is turned on, and thereby, the line feed direction in which the printer 101 is moved in the −Y direction and the −X direction as the designated direction for the next pass are shown. Further, the leftward direction indicator 118*b* is turned on, and thereby, the −X direction as the designated direction for the next pass is shown.

Figure 23:
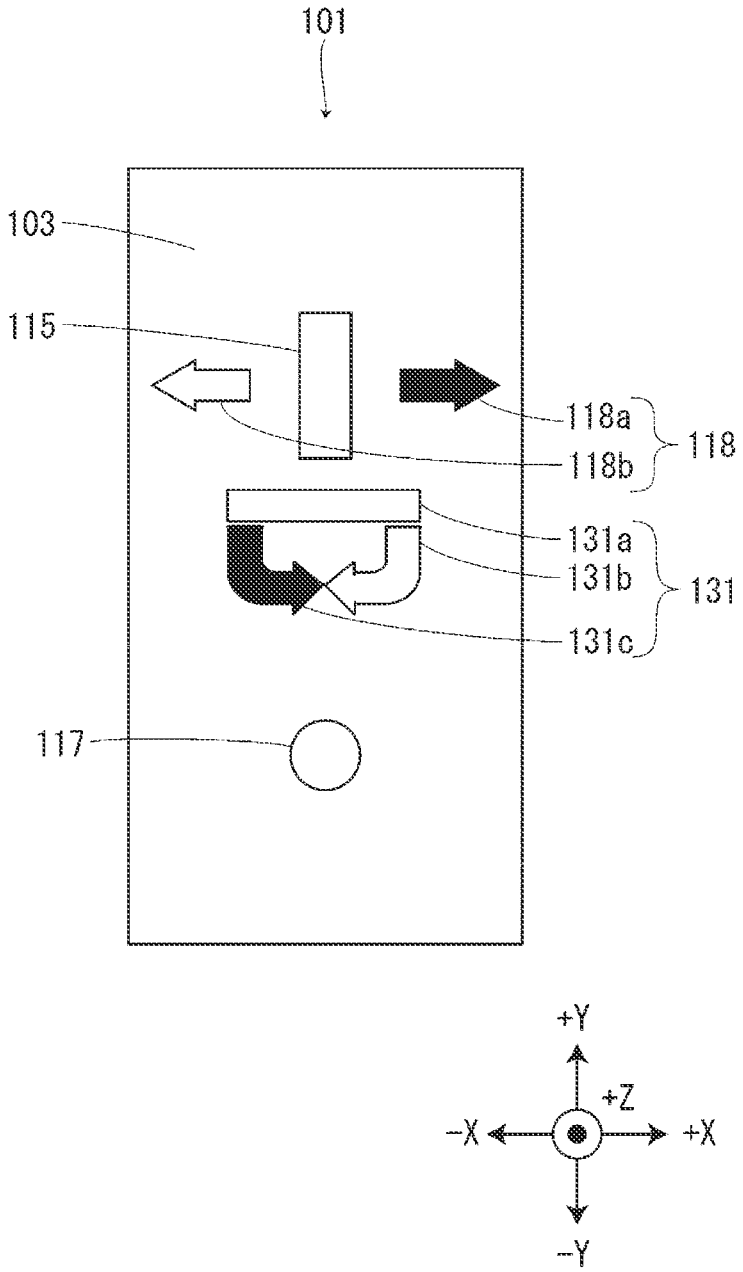
FIG. 23 shows an example of lighting states of the direction indicator and the line feed indicator different from FIGS. 21 and 22.

FIG. 23 shows states of the direction indicator 118 and the line feed indicator 131 when the bidirectional mode is selected and printing is performed in a plurality of passes, and when the printing of the other even-numbered passes than the final pass is finished. As shown in the drawing, the second bending indicator 131*c* is turned on, and thereby, the line feed direction in which the printer 101 is moved in the −Y direction and the +X direction as the designated direction for the next pass are shown. Further, the rightward direction indicator 118*a* is turned on, and thereby, the +X direction as the designated direction for the next pass is shown.

Figure 24:
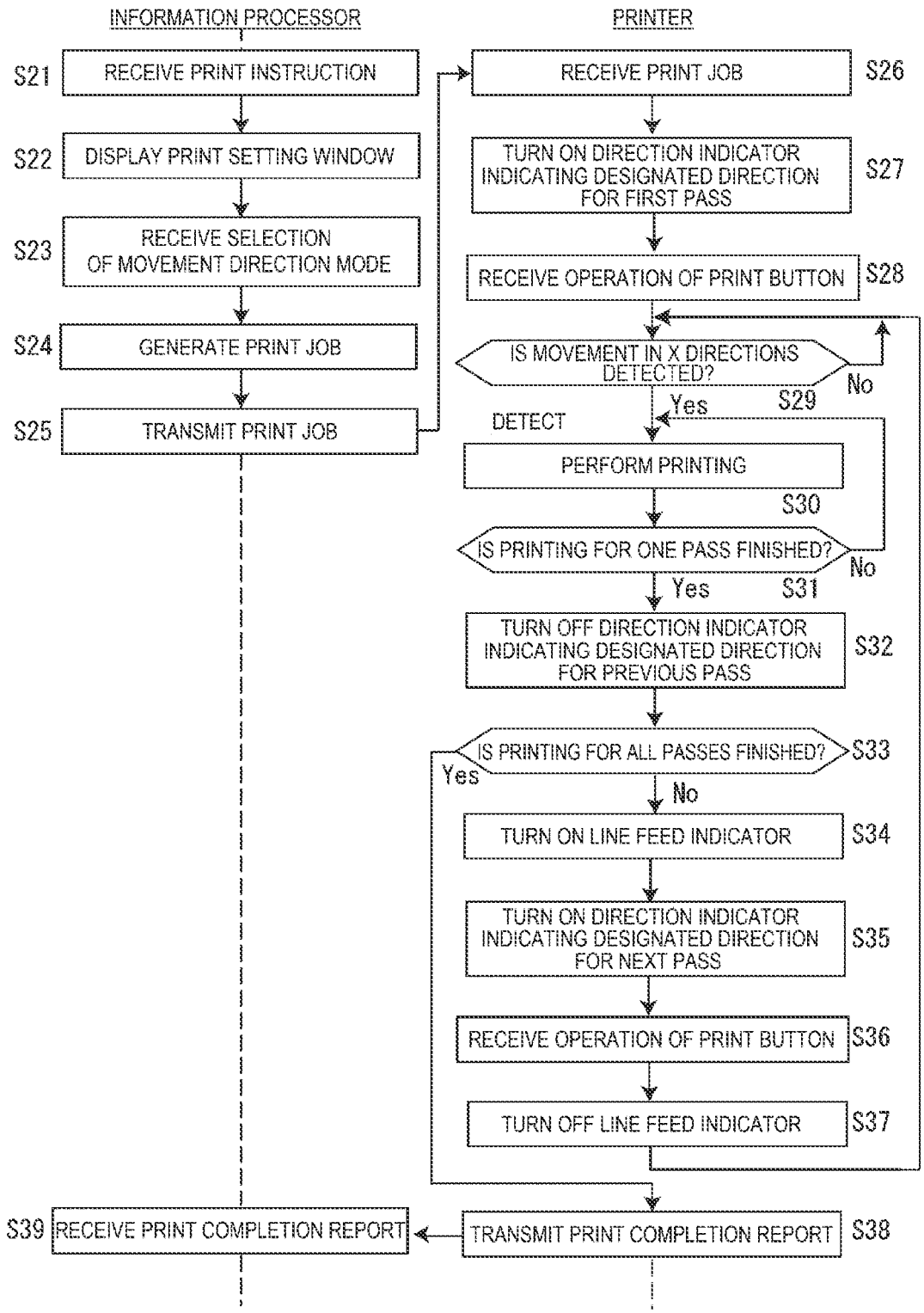
FIG. 24 is a flowchart showing print control processing executed by an information processor and print processing executed by the printer of the second embodiment.

Referring to FIG. 24, print control processing executed by the information processor 1 and print processing executed by the printer 101 of the second embodiment will be explained. The information processor 1 executes step S21 to step S25 like step S01 to step S05 (see FIG. 15).

At step S26, the printer 101 receives the print job transmitted from the information processor 1.

At step S27, the printer 101 turns on the direction indicator 118 indicating the designated direction for the first pass. That is, the printer 101 turns on the rightward direction indicator 118*a*.

At step S28, the printer 101 receives the operation of the print button 115 by the user 301.

At step S29, the printer 101 determines whether or not the movement of the printer 101 in the X directions is detected by the movement detection sensor 125. When determining that the movement of the printer 101 in the X directions is detected, the printer 101 moves to step S30. Or, when determining that the movement of the printer 101 in the X directions is not detected, the printer 101 repeats step S29.

At step S30, the printer 101 performs printing by controlling the print head 121.

At step S31, the printer 101 determines whether or not printing for one pass is finished. When determining that the printing for one pass is finished, the printer 101 moves to step S32. Or, when determining that the printing for one pass is not finished, the printer 101 returns to step S30.

At step S32, the printer 101 turns off the direction indicator 118 indicating the designated direction for the previous pass, i.e., the pass for which printing is finished at step S31.

At step S33, the printer 101 determines whether or not printing for all passes is finished. When determining that printing for all passes is finished, the printer 101 moves to step S38. Or, when determining that printing for all passes is not finished, the printer 101 returns to step S34.

At step S34, the printer 101 turns on the line feed indicator 131. For example, when the unidirectional mode is selected, the printer 101 turns on the linear indicator 131*a* and the second bending indicator 131*c*. Further, when the bidirectional mode is selected, and when the printing of the odd-numbered pass is finished at step S30, the printer 101 turns on the first bending indicator 131*b*. Furthermore, when the bidirectional mode is selected, and when the printing of the even-numbered pass is finished at step S30, the printer 101 turns on the second bending indicator 131*c*.

At step S35, the printer 101 turns on the direction indicator 118 indicating the designated direction for the next pass. For example, when the unidirectional mode is selected, the printer 101 turns on the rightward direction indicator

118*a*. Further, when the bidirectional mode is selected, and when the printing of the odd-numbered pass is finished at step S30, the printer 101 turns on the leftward direction indicator 118*b*. Furthermore, when the bidirectional mode is selected, and when the printing of the even-numbered pass is finished at step S30, the printer 101 turns on the rightward direction indicator 118*a*.

At step S36, the printer 101 receives the operation of the print button 115 by the user 301.

At step S37, the printer 101 turns off the line feed indicator 131. The printer 101 executes step S37, and then, returns to step S29.

At step S38, the printer 101 transmits a print completion report representing that the printing is completed to the information processor 1.

At step S39, the information processor 1 receives the print completion report transmitted from the printer 101.

As described above, after the movement of the printer 101 for one pass is ended and before the movement for the next pass is started, the printer 101 of the second embodiment notifies the user 301 to perform line feed. Accordingly, the user 301 may perform line feed at an appropriate time.

Further, the printer 101 notifies the user 301 of the line feed direction based on the designated direction for each pass designated by the print job. Accordingly, the user 301 may perform line feed in an appropriate line feed direction.

Furthermore, the printer 101 forms the line feed indicator 131 by an indicator group in which the linear indicator 131*a*, the first bending indicator 131*b*, and the second bending indicator 131*c* are arranged in the annular form. Accordingly, the line feed indicator 131 may be realized in a smaller space. The printer 101 may use the second bending indicator 131*c* for both the notification of the line feed direction by the first line feed notification part and the notification of the line feed direction by the second line feed notification part.

Note that, in the second embodiment, the following modified examples can be employed.

Modified Example 2-1

Figure 25:
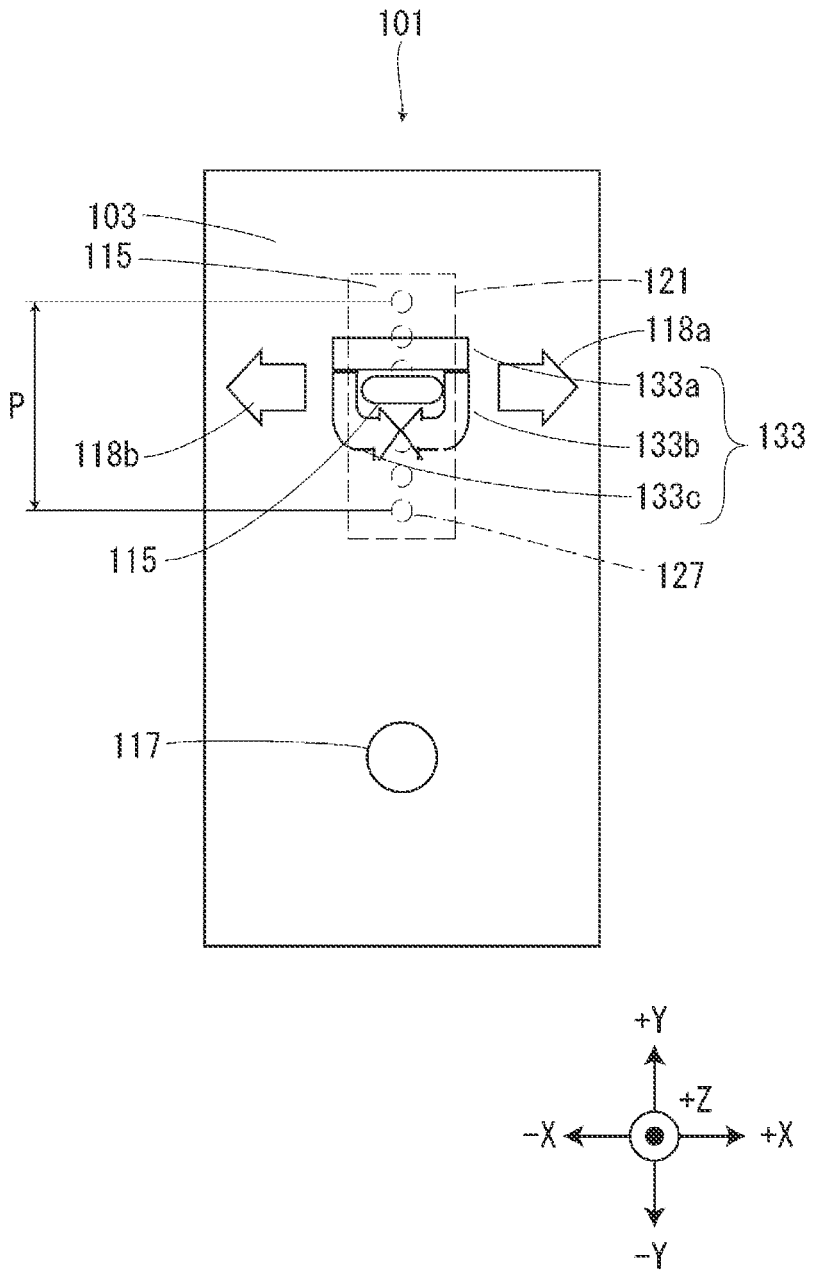
FIG. 25 shows a printer having a line feed indicator of a modified example.

FIG. 25 shows a printer 101 having a line feed indicator 133 of Modified Example 2-1. The line feed indicator 133 of the modified example is located in a position corresponding to the print head 121 in the Y directions on the first outer surface 103. Here, the line feed indicator 133 located in the position corresponding to the print head 121 in the Y directions refers to the line feed indicator 133 located within a range of the print head 121 in the Y directions.

In the line feed indicator 133 of the modified example, a linear indicator 133*a*, a first bending indicator 133*b*, and a second bending indicator 133*c* are arranged in an annular form like the line feed indicator 131 of the second embodiment. Further, a print button 115 is provided in a center portion surrounded by the linear indicator 133*a*, the first bending indicator 133*b*, and the second bending indicator 133*c*. In the modified example, the rightward direction indicator 118*a* is provided at a side in the +X direction relative to the line feed indicator 133 and the leftward direction indicator 118*b* is provided at a side in the −X direction relative to the line feed indicator 133.

As described above, the printer 101 of the modified example may show the position in which the print head 121 is provided, i.e., the position of the printable range P by the print head 121 to the user 301 by the line feed indicator 133. Further, the print button 115 is provided in the center portion of the line feed indicator 133, and thereby, the placement space of the print button 115 and the line feed indicator 133 may be reduced.

Modified Example 2-2

Figure 26:
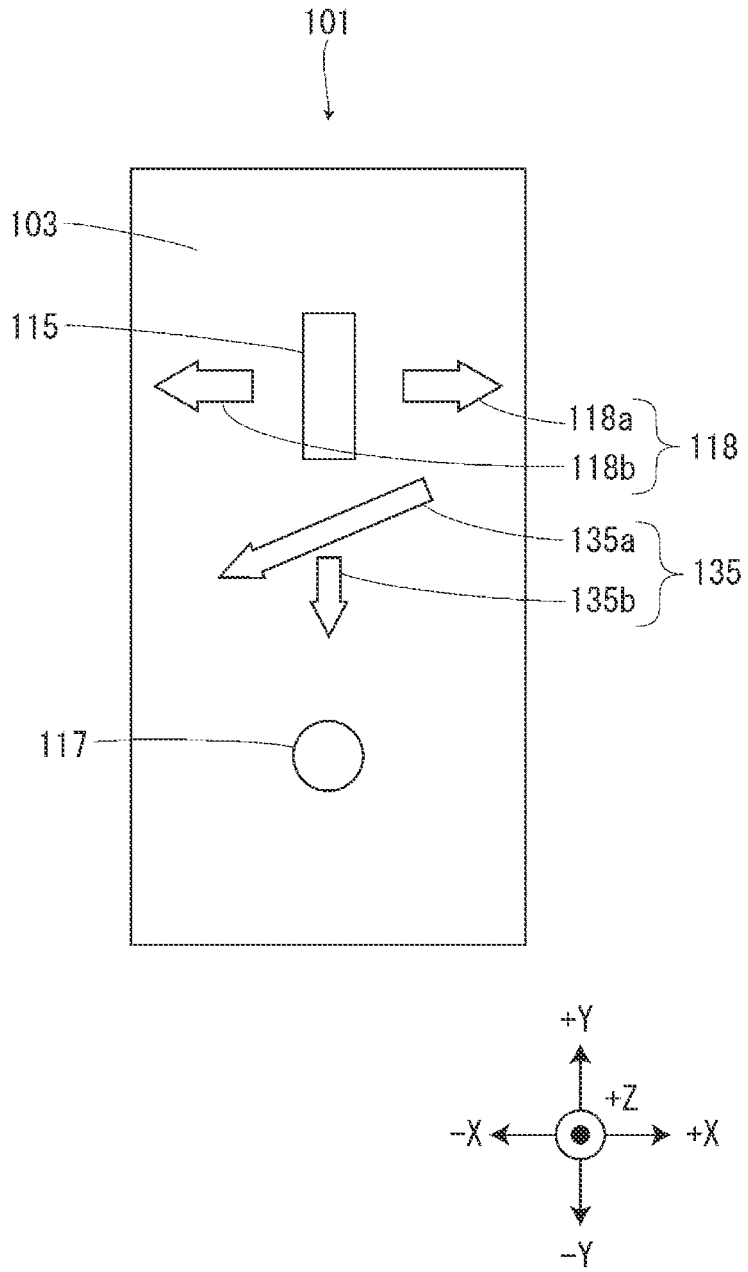
FIG. 26 shows a printer having a line feed indicator of a modified example different from FIG. 25.

FIG. 26 shows a printer 101 having a line feed indicator 135 of Modified Example 2-2. The line feed indicator 135 of the modified example is located at a side in the −Y direction relative to the print button 115 and at a side in the +Y direction relative to the power button 117. Further, the line feed indicator 135 of the modified example includes a left downward direction line feed indicator 135*a* as a linear indicator indicating an oblique direction in the +X direction and the −Y direction by an arrow and a downward direction line feed indicator 135*b* as a linear indicator indicating the −Y direction by an arrow.

When the unidirectional mode is selected, the printer 101 of the modified example notifies the user 301 of the line feed direction by turning on the left downward direction line feed indicator 135*a*. Further, when the bidirectional mode is selected, the printer 101 of the modified example notifies the user of the line feed direction by turning on the downward direction line feed indicator 135*b*. Note that the printer 101 of the modified example turns on the downward direction line feed indicator 135*b* when a pass is finished regardless whether an odd-numbered pass is finished or an even-numbered pass is finished.

As described above, the printer 101 of the modified example may notify the user 301 of the line feed direction using the two indicators.

As another modified example, the line feed indicator 135 does not necessarily have arrow shapes as the end shapes indicating the line feed direction. For example, the left downward direction line feed indicator 135*a* and the downward direction line feed indicator 135*b* may have rectangular shapes as a whole.

Similarly, the end shapes indicating the line feed direction of the first bending indicator 131*b* and the second bending indicator 131*c* may be other shapes than the arrow shapes.

Modified Example 2-3

Figure 27:
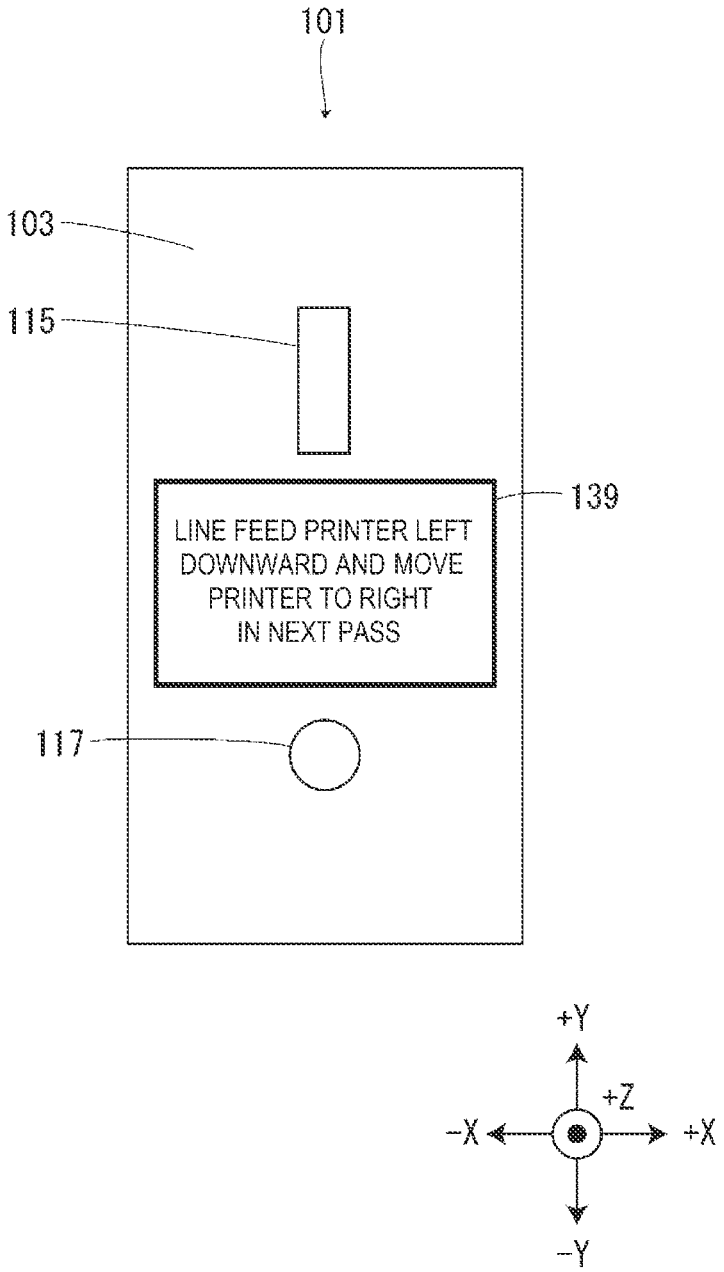
FIG. 27 shows a printer having a display.

The printers 101 of the above described embodiments notify the user 301 of the designated direction and the line feed using the indicators, however, the printer may notify the user 301 using other members than the indicators. For example, as shown in FIG. 27, the printer may notify the user 301 using a display 139. In this case, the printer 101 may display a message that "move printer to right in next pass" showing the designated direction on the display 139. Or, the printer 101 may display a message that "line feed printer left downward" showing the line feed direction on the display 139.

As another modified example, the display 139 may be placed in a location corresponding to the print head 121 in the Y directions.

Or, the printers 101 may notify the user 301 of the designated direction and the line feed by sound.

Modified Example 2-4

The printers 101 of the above described embodiments notify the user of the designated direction by lighting the direction indicator 118, however, the printer may notify the user of the designated direction by blinking the direction indicator 118. Similarly, the printer 101 may notify the user of the line feed direction by not lighting, but by blinking the direction indicator 131.

Modified Example 2-5

The printers 101 of the above described embodiments turn on the line feed indicator 131 when printing for one pass is finished, however, may turn on the line feed indicator 131 before printing for one pass is finished.

As another modified example, when printing is performed with the print button 115 pressed and held, the printer 101 may turn on the line feed indicator 131 when the pressed print button 115 is released.

Modified Example 2-6

The printers 101 of the above described embodiments turn off the line feed indicator 131 when receiving the operation of the print button 115, however, the printer may turn off the line feed indicator 131 when detecting movement of the printer 101 in the Y directions.

As another modified example, the printer 101 may turn off the line feed indicator 131 when a predetermined time elapses from the start of lighting of the line feed indicator 131.

In addition, the following modified examples can be employed in both the first embodiment and the second embodiment.

Modified Example 3-1

The printers 101 of the above described embodiments acquire the print jobs from the information processor 1, however, the printers themselves may generate the print jobs. Further, when printing the print image 203 in a plurality of passes, the printer 101 may acquire each job per pass, not acquire the print job containing a plurality of print jobs per pass. In this case, the printer 101 may request a job per pass in the next pass to the information processor 1 when receiving the operation of the print button 115 or when ending the printing of the pass.

Modified Example 3-2

The print head 121 is not limited to the inkjet head, but may be a thermal head for printing by thermal transfer. In addition, changes can be appropriately made without departing from the scope of the present disclosure.

Additional Description

As below, the printer and the control method for the printer will be additionally described.

The printer 101 is the printer 101 that performs printing on the medium while being manually moved relative to the medium, including the job acquisition unit that acquires the print job in which the movement direction of the printer 101 as seen from the printer 101 is designated, the print head 121 that performs printing on the medium based on the print job while the printer 101 is moved, and the direction notification unit that notifies the user 301 of the designated direction as the movement direction of the printer 101 designated by the print job before the movement of the printer 101 is started.

A control method for the printer 101 is a control method for the printer 101 that performs printing on the medium while being manually moved relative to the medium, including acquiring the print job in which the movement direction of the printer 101 as seen from the printer 101 is designated, performing printing on the medium based on the print job while the printer 101 is moved, and notifying the user 301 of the designated direction as the movement direction of the printer 101 designated by the print job before the movement of the printer 101 is started.

According to the configuration, the printer 101 notifies the user 301 of the designated direction as the movement direction of the printer 101 designated by the print job before the movement is started. Therefore, the user 301 may move the printer 101 in the movement direction designated by the print job, and may control the printer to appropriately print the print image.

In the above described printer 101, it is preferable that a line feed notification unit that notifies the user 301 to perform line feed as the movement of the printer 101 from the movement end position of the printer 101 for one pass to the movement start position for the next pass after the movement of the printer 101 for one pass is ended and before the movement for the next pass is started is provided.

According to the configuration, the printer 101 notifies the user 301 to perform line feed after the movement for one pass is ended and before the movement for the next pass is started. Therefore, the user 301 may perform line feed at an appropriate time.

In the above described printer 101, it is preferable that the line feed notification unit notifies the user 301 of the line feed direction as the direction in which the printer 101 is moved for the line feed based on the designated direction for each pass designated by the print job.

According to the configuration, the printer 101 notifies the user 301 of the line feed direction as the direction in which the printer 101 is moved for line feed based on the designated direction for each pass designated by the print job. Therefore, the user 301 may perform line feed in an appropriate line feed direction.

In the above described printer 101, it is preferable that the line feed notification unit has one or more line feed indicators that notify the user of the line feed direction.

According to the configuration, the printer 101 notifies the user of the line feed direction using one or more line feed indicators. Therefore, the user 301 may know the line feed direction by visually recognizing the one or more line feed indicators.

In the above described printer 101, it is preferable that the line feed notification unit includes a first line feed direction notification part that notifies the user of the line feed direction when the designated direction for each pass designated by the print job is the same direction and a second line feed direction notification part that notifies the user of the line feed direction when the designated direction for each pass designated by the print job is opposite to each other between the odd-numbered pass and the even-numbered pass.

According to the configuration, the printer 101 includes the first line feed direction notification part that notifies the user of the line feed direction when the designated direction for each pass designated by the print job is the same direction and the second line feed direction notification part that notifies the user of the line feed direction when the designated direction for each pass designated by the print job is opposite to each other between the odd-numbered pass and the even-numbered pass. Therefore, the user 301 may know the line feed direction based on which of the first line feed direction notification part and the second line feed direction notification part notified.

In the above described printer 101, it is preferable that the line feed indicator is an indicator group of a linear indicator extending in the designated direction, a first bending indicator starting from one end of the linear indicator, and a second bending indicator starting from the other end of the linear indicator arranged in an annular form, the first line feed direction notification part notifies the user of the line feed direction by simultaneously turning on the linear indicator and the second bending indicator, and the second line feed direction notification part notifies the user of the line feed direction by switching and lighting one of the first bending indicator and the second bending indicator for each pass.

According to the configuration, the printer 101 may realize the first line feed direction notification part and the second line feed direction notification part in a smaller space by arrangement of the three indicators in the annular shape. Further, the printer 101 may use the first bending indicator for both the notification by the first line feed notification part and the notification by the second line feed notification part.

In the above described printer 101, it is preferable that the direction notification unit has one or more direction indicators, and the one or more direction indicators are provided on an opposite surface as an outer surface at an opposite side to the outer surface with the print head 121 provided thereon of a plurality of outer surfaces of the printer 101 and located in the position corresponding to the print head 121 in a second direction orthogonal to the designated direction within the opposite surface.

According to the configuration, the printer 101 may show the position in which the print head 121 is provided in the second direction of the printer 101 to the user 301 using the one or more direction indicators.

In the above described printer 101, it is preferable that the line feed notification unit has one or more line feed indicators, and the one or more line feed indicators are provided on an opposite surface as an outer surface at an opposite side to the outer surface with the print head 121 provided thereon of a plurality of outer surfaces of the printer 101 and located in the position corresponding to the print head 121 in a second direction orthogonal to the designated direction within the opposite surface.

According to the configuration, the printer 101 may show the position in which the print head 121 is provided in the second direction of the printer 101 to the user 301 using the one or more line feed indicators.

In the above described printer 101, it is preferable that the direction notification unit ends the notification of the designated direction when the movement of the printer 101 for one pass is ended.

According to the configuration, the printer 101 ends the notification of the designated direction when the movement of the printer 101 for one pass is finished. Therefore, the user 301 may know that the movement for one pass is finished.

In the above described printer 101, it is preferable that the print head 121 has a first nozzle row and a second nozzle row provided in parallel to the first nozzle row and apart from the first nozzle row in the designated direction, and, when printing using both the first nozzle row and the second nozzle row is performed, the direction notification unit delays a time to end the notification of the designated direction to be later than that when printing using one of the first nozzle row and the second nozzle row is performed.

According to the configuration, when printing using both the first nozzle row and the second nozzle row is performed, the printer 101 may notify the user 301 of the designated direction in a longer period than that when printing using one of the first nozzle row and the second nozzle row is performed.

What is claimed is:

1. A printer that performs printing on a medium while being manually moved relative to the medium, comprising:

a job acquisition unit that acquires a print job in which a movement direction of the printer is designated;

a print head that performs printing on the medium based on the print job while the printer is moved; and a direction notification unit that notifies a user of a designated direction that is the movement direction of the printer designated by the print job before the movement of the printer is started, the direction notification unit ends the notification of the designated direction when the movement of the printer for one pass is ended, wherein the print head has:

a first nozzle row;

a second nozzle row provided in parallel to the first nozzle row and apart from the first nozzle row in the designated direction, and when printing using both the first nozzle row and the second nozzle row is performed, the direction notification unit delays a time to end the notification of the designated direction to be later than that when printing using one of the first nozzle row and the second nozzle row is performed.

2. The printer according to claim 1, further comprising a line feed notification unit that notifies the user to perform line feed as the movement of the printer from a movement end position of the printer for one pass to a movement start position for the next pass after the movement of the printer for one pass is ended and before the movement for the next pass is started.

3. The printer according to claim 2, wherein the line feed notification unit notifies the user of a line feed direction as a direction in which the printer is moved for the line feed based on the designated direction for each pass designated by the print job.

4. The printer according to claim 3, wherein the line feed notification unit has one or more line feed indicators that notify the user of the line feed direction.

5. The printer according to claim 4, wherein the line feed notification unit includes:

a first line feed direction notification part that notifies the user of the line feed direction when the designated direction for each pass designated by the print job is the same direction; and a second line feed direction notification part that notifies the user of the line feed direction when the designated direction for each pass designated by the print job is opposite to each other between an odd-numbered pass and an even-numbered pass.

6. The printer according to claim 5, wherein the one or more line feed indicators are an indicator group of a linear indicator extending in the designated direction, a first bending indicator starting from one end of the linear indicator, and a second bending indicator starting from the other end of the linear indicator arranged in an annular form, the first line feed direction notification part notifies the user of the line feed direction by simultaneously turning on the linear indicator and the second bending indicator, and the second line feed direction notification part notifies the user of the line feed direction by switching and lighting one of the first bending indicator and the second bending indicator for each pass.

7. The printer according to claim 2, wherein the line feed notification unit has one or more line feed indicators, and the one or more line feed indicators are provided on an opposite surface as an outer surface at an opposite side to an outer surface with the print head provided thereon of a plurality of outer surfaces of the printer and located in a position corresponding to the print head in a second direction orthogonal to the designated direction within the opposite surface.

8. The printer according to claim 1, wherein the direction notification unit has one or more direction indicators, and the one or more direction indicators are provided on an opposite surface as an outer surface at an opposite side to an outer surface with the print head provided thereon of a plurality of outer surfaces of the printer and located in a position corresponding to the print head in a second direction orthogonal to the designated direction within the opposite surface.

9. A control method for a printer that performs printing on a medium while being manually moved relative to the medium, comprising:

acquiring a print job in which a movement direction of the printer is designated;

performing printing on the medium based on the print job using a print head and while the printer is moved; and notifying a user of a designated direction that is the movement direction of the printer designated by the print job before the movement of the printer is started and ending the notification of the designated direction when the movement of the printer for one pass is ended wherein the print head has:

a first nozzle row;

a second nozzle row provided in parallel to the first nozzle row and apart from the first nozzle row in the designated direction, and when performing printing using both the first nozzle row and the second nozzle row is performed, delaying a time to end the notification of the designated direction to be later than that when printing using one of the first nozzle row and the second nozzle row is performed.

10. A printer that performs printing on a medium while being manually moved relative to the medium, comprising:

a job acquisition unit that acquires a print job in which a movement direction of the printer is designated;

a print head that performs printing on the medium based on the print job while the printer is moved;

a direction notification unit that notifies a user of a designated direction that is the movement direction of the printer designated by the print job before the movement of the printer is started; and a line feed notification unit that notifies the user to perform line feed as the movement of the printer from a movement end position of the printer for one pass to a movement start position for the next pass after the movement of the printer for one pass is ended and before the movement for the next pass is started, the line feed notification unit notifies the user of a line feed direction as a direction in which the printer is moved for the line feed based on the designated direction for each pass designated by the print job, the line feed notification unit has one or more line feed indicators that notify the user of the line feed direction, wherein, the line feed notification unit includes:

a first line feed direction notification part that notifies the user of the line feed direction when the designated direction for each pass designated by the print job is the same direction;

a second line feed direction notification part that notifies the user of the line feed direction when the designated direction for each pass designated by the print job is opposite to each other between an odd-numbered pass and an even-numbered pass;

the one or more line feed indicators are an indicator group of a linear indicator extending in the designated direction, a first bending indicator starting from one end of the linear indicator, and a second bending indicator starting from the other end of the linear indicator arranged in an annular form;

the first line feed direction notification part notifies the user of the line feed direction by simultaneously turning on the linear indicator and the second bending indicator, and the second line feed direction notification part notifies the user of the line feed direction by switching and lighting one of the first bending indicator and the second bending indicator for each pass.

* * * * *